United States Patent [19]

Aoki et al.

[11] 4,159,663

[45] Jul. 3, 1979

[54] ELECTRONIC MUSICAL INSTRUMENT WITH DIFFERENT TYPES OF TONE FORMING SYSTEMS

[75] Inventors: Eiichiro Aoki; Tsutomu Suzuki, both of Hamamatsu, Japan

[73] Assignee: Nippon Gakki Seizo Kabushiki Kaisha, Hamamatsu, Japan

[21] Appl. No.: 845,593

[22] Filed: Oct. 26, 1977

[30] Foreign Application Priority Data

Oct. 28, 1976 [JP] Japan ..... 51/129825

[51] Int. Cl.[2] ..... G10H 1/02

[52] U.S. Cl. ..... 84/1.24; 84/1.11; 84/1.19

[58] Field of Search ..... 84/1.11, 1.19, 1.21, 84/DIG. 2, DIG. 4, DIG. 22, 1.24

[56] References Cited

U.S. PATENT DOCUMENTS 3,766,305 10/1973 Schrecongost ..... 84/DIG. 2

3,823,246 7/1974 Hebeisen ..... 84/DIG. 22

3,825,667 7/1974 Schrecongost ..... 84/DIG. 2

*Primary Examiner*—J. V. Truhe

*Assistant Examiner*—Leonard W. Pojunas, Jr.

*Attorney, Agent, or Firm*—Spensley, Horn, Jubas & Lubitz

[57] ABSTRACT

An electronic musical instrument comprises a plurality of musical tone forming systems capable of producing musical tones of different tone qualities. A priority is established between the respective musical tone forming systems and one which is of a highest priority among one or more such systems selected by a performer is automatically selected and a musical tone can be produced only from this selected system of the highest priority. The electronic musical instrument is capable also of producing musical tones from a plurality of predetermined systems simultaneously when the priority is rendered nonoperative thereby to produce an ensemble effect.

12 Claims, 8 Drawing Figures

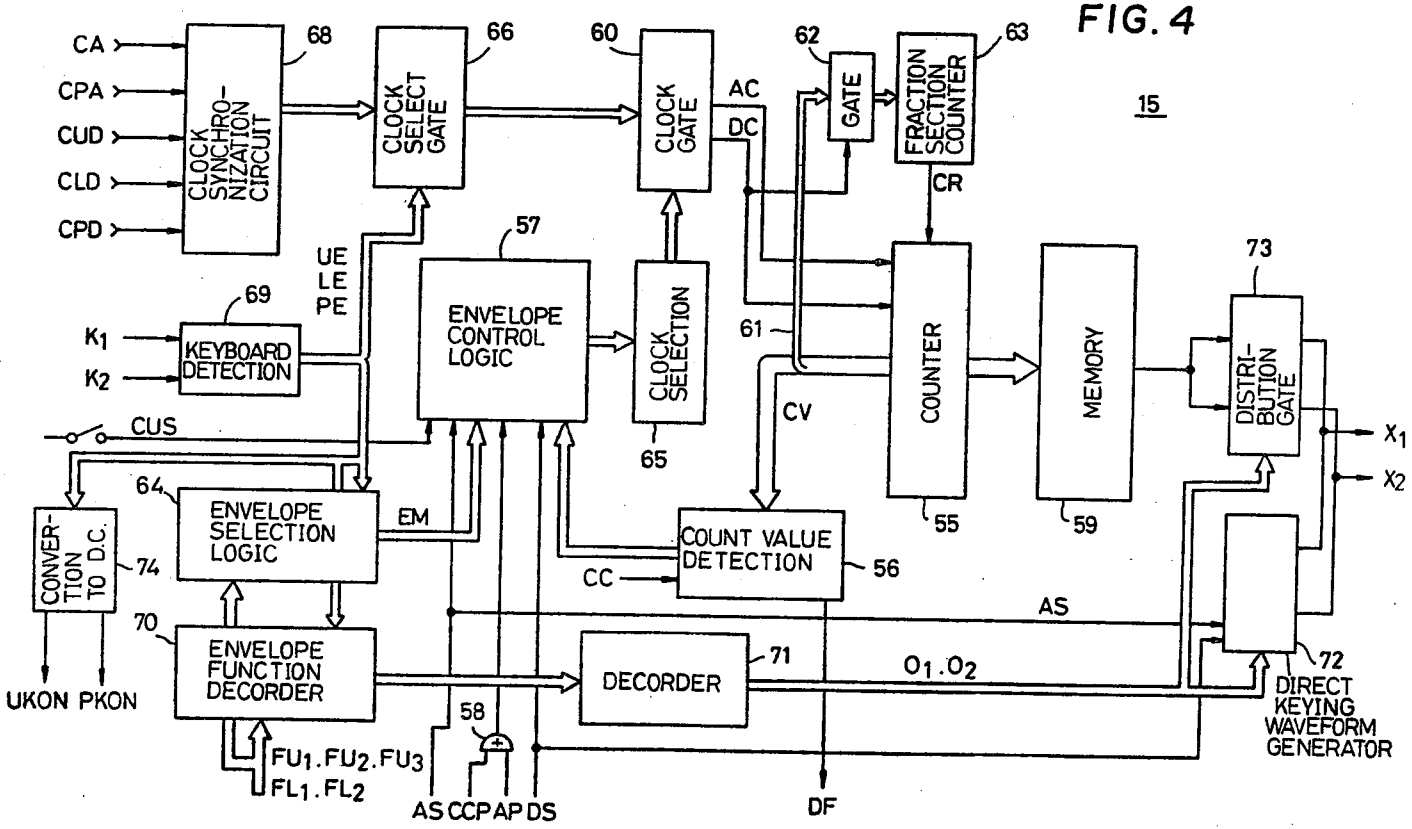
FIG. 4
15
CA
CPA
CUD
CLD
CPD
CLOCK SYNCHRO-NIZATION CIRCUIT
68
CLOCK SELECT GATE
66
CLOCK GATE
60
AC
DC
GATE
62
FRACTION SECTION COUNTER
63
CR
KEYBOARD DETECTION
69
K1
K2
UE
LE
PE
CUS
CLOCK SELECTION
65
ENVELOPE CONTROL LOGIC
57
COUNTER
55
CV
61
MEMORY
59
DISTRI-BUTION GATE
73
X1
X2
COUNT VALUE DETECTION
56
CC
EM
ENVELOPE SELECTION LOGIC
64
CONVER-TION TO D.C.
74
UKON PKON
AS
O1.O2
DF
DECORDER
71
DIRECT KEYING WAVEFORM GENERATOR
72
58
AS CCP AP DS
ENVELOPE FUNCTION DECORDER
70
FU1.FU2.FU3
FL1.FL2

ELECTRONIC MUSICAL INSTRUMENT WITH DIFFERENT TYPES OF TONE FORMING SYSTEMS

BACKGROUND OF THE INVENTION

This invention relates to an electronic musical instrument having a plurality of musical tone forming systems capable of producing musical tones different in tone quality, and more particularly to a tone production control of the different types of the musical tone forming systems of the electronic musical instrument.

Various methods of forming musical tones in electronic musical instruments have been proposed. For instance, the following methods are well known in the art:

(1) A method in which out of a waveform memory in which a musical tone waveform of a predetermined tone color is stored, the musical tone waveform is repeatedly read to produce a musical tone.

(2) A method in which the relative amplitudes of various harmonic components are individually controlled, and thereafter mixed to produce a musical tone waveform signal having one desired tone color.

(3) A method in which a tone source waveform signal having a number of harmonic components is applied to a fixed type filter (formant filter) realizing a predetermined tone color, thereby to effect tone color formation.

(4) A method in which a tone source waveform signal having a number of harmonic components is applied to a voltage controlled type filter, thereby to effect intricate tone color formation.

It is true that each of the above-described conventional methods has its own superiority and merits. However, if these methods are separately applied to an electronic musical instrument, the performance of the musical instrument is biased, and accordingly it is impossible to provide an ideal electronic musical instrument. One of the ideal images for the electronic musical instrument resides in that the electronic musical instrument is so designed as to freely produces various musical tones different in tone quality, thereby to improve its performance ability as a musical instrument. For this purpose, it is desirable that a plurality of musical tone forming systems capable of individually producing musical tones different in tone quality according to different musical tone forming methods are incorporated in one and the same electronic musical instrument, and the musical tones formed by the various systems are simultaneously or selectively produced.

If an improved electronic musical instrument having the above-described plurality of musical tone forming systems is provided, then undoubtedly the electronic musical instrument will have a number of operating levers for controlling tone color, tone volume, tone pitch, etc. Accordingly, such an electronic musical instrument may suffer from the disadvantage that it is difficult for the performer to carry out the switching operations of the various control levers provided for the various musical tone forming systems. In other words, as the musical tone controls (the controls of tone color, tone volume, tone pitch, etc.) are carried out separately according to the various musical tone forming systems, there are provided a number of operating levers for each of the systems, and accordingly the number of operating levers as a whole is extremely increased. Therefore, for instance, when it is intended to change one musical tone forming system to another one during the performance, the performer must carry out a troublesome switching operation that after setting the operating levers of the musical tone forming system being employed to the off positions, he has to operate desired operating levers of a new musical tone forming system.

SUMMARY OF THE INVENTION

In view of the foregoing, an object of this invention is to provide an electronic musical instrument having a plurality of musical tone forming system, in which a priority order is established for these musical tone forming systems, and one having a highest priority out of one or plural musical tone forming system selected by the performer is automatically selected whereby musical tones are produced only in the system having the highest priority mentioned above, and in which, if necessary, the priority order is cancelled so that musical tones are produced simultaneously in predetermined plural systems.

The priority order is, according to the invention, established for the musical tone forming systems, as was described above. Therefore, merely by operating the operating levers of the system having a highest priority only the tones of that system can be produced, and the system having the highest priority can be automatically selected without setting the operating levers of the system lower in priority than the firstly mentioned system. Accordingly, the performer's burden is considerably reduced. Furthermore, according to this invention, merely by operating an ensemble switch, the priority order is cancelled so that musical tones are produced in a parallel mode in predetermined musical tone forming system; that is, in this case, the switching operations of the operating levers or the like for musical tone control are not especially required, and therefore the performance can be readily effected.

The foregoing object and other objects as well as the characteristic features of the present invention will be-come more apparent from the following detailed description and the appended claims when read in conjunction with the accompanying drawings, in which like parts are designated by like reference numerals or characters.

BRIEF DESCRIPTION OF THE DRAWINGS

In the accompanying drawings:

FIG. 4 is a block diagram showing one example of an enevelope generator shown in FIG. 1;

DETAILED DESCRIPTION OF THE INVENTION

One preferred example of the electronic musical instrument according to this invention will be described with reference to the accompanying drawings.

Figure 1:
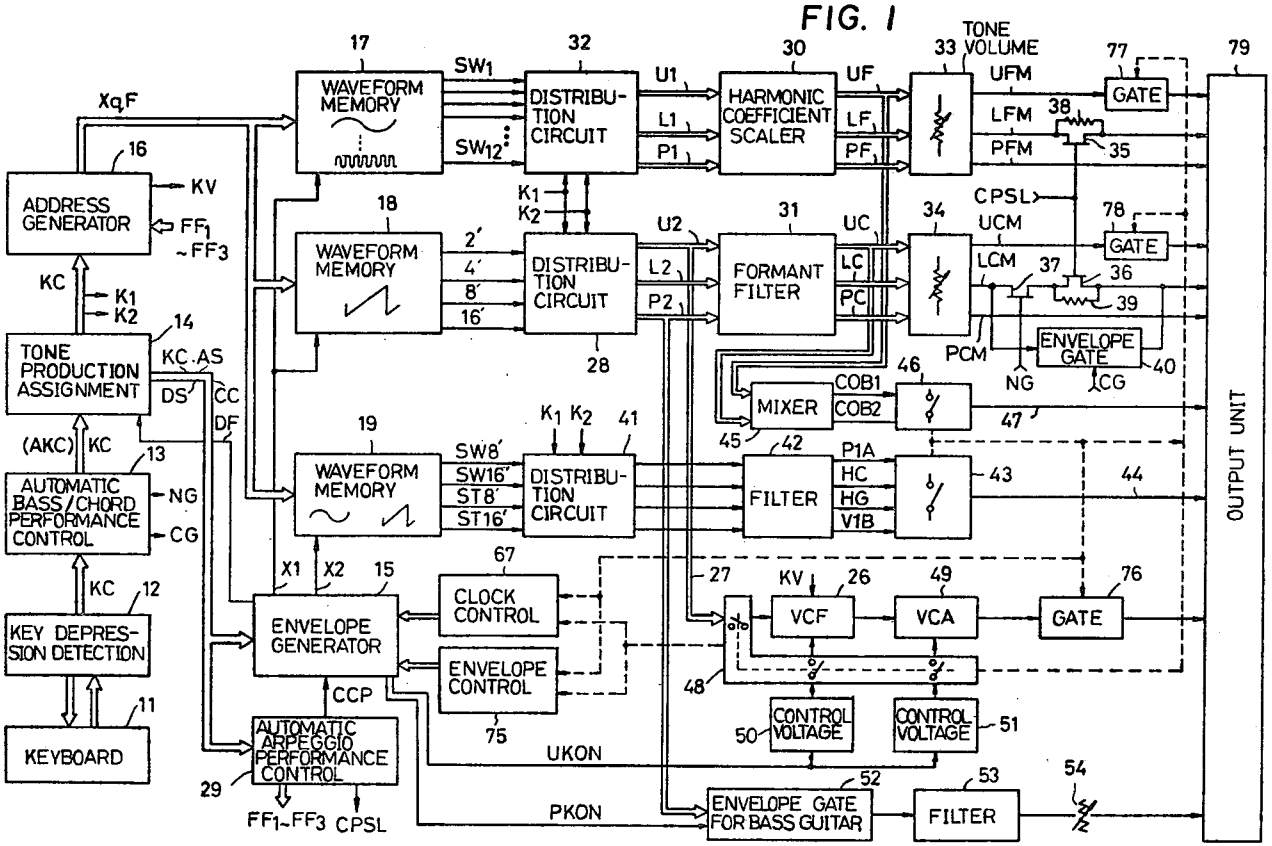
FIG. 1 is a block diagram showing one example of an electronic musical instrument according to this invention.

The electronic musical instrument shown in FIG. 1 comprises a keyboard 11 consisting of an upper keyboard, a lower keyboard, and a pedal keyboard, and is so designed that different musical tones are formed separately according to the keyboards. Through a tone production assignment in time division manner effected in a tone production assignment circuit 14, one or plural tones of depressed keys in the keyboard 11 are produced in time division manner. In this example, various musical tone forming systems are provided for the upper keyboard tone, and priority order is established for these systems so that the systems producing musical tones are automatically switched in accordance with this priority order.

Referring to FIG. 1, a keyboard 11 comprises the upper keyboard, the lower keyboard, and a pedal keyboard, for instance, and a key depression detecting circuit 12 operates to detect a depressed key and to produce a key code KC representative of the depressed key. The key code KC, as indicated in Table 1, consists of a 2-bit keyboard code $K_1$, $K_2$ representative of the kind of keyboard, a 3-bit octave code $B_1$, $B_2$, $B_3$ representative of an octave range and a 4-bit note code $N_1$, $N_2$, $N_3$, $N_4$ representative of a note out of twelve notes in one octave. For example, the key code KC representing the note F in the thrid octave on the pedal keyboard is "110100101".

Table 1

| | | Key code KC | | | | | | | | |
|---|---|---|---|---|---|---|---|---|---|---|
| Key | | $K_2$ | $K_1$ | $B_3$ | $B_2$ | $B_1$ | $N_4$ | $N_3$ | $N_2$ | $N_1$ |
| Keyboard | Upper | 0 | 1 | | | | | | | |
| | Lower | 1 | 0 | | | | | | | |
| | Pedal | 1 | 1 | | | | | | | |
| | 1st | | | 0 | 0 | 0 | | | | |
| | 2nd | | | 0 | 0 | 1 | | | | |
| Octave | 3rd | | | 0 | 1 | 0 | | | | |
| | 4th | | | 0 | 1 | 1 | | | | |
| | 5th | | | 1 | 0 | 0 | | | | |
| | 6th | | | 1 | 0 | 1 | | | | |
| Note | C# | | | | | | 0 | 0 | 0 | 0 |
| | D | | | | | | 0 | 0 | 0 | 1 |
| | D# | | | | | | 0 | 0 | 1 | 0 |
| | E | | | | | | 0 | 1 | 0 | 0 |
| | F | | | | | | 0 | 1 | 0 | 1 |
| | F# | | | | | | 0 | 1 | 1 | 0 |
| | G | | | | | | 1 | 0 | 0 | 0 |
| | G# | | | | | | 1 | 0 | 0 | 1 |
| | A | | | | | | 1 | 0 | 1 | 0 |
| | A# | | | | | | 1 | 1 | 0 | 0 |
| | B | | | | | | 1 | 1 | 0 | 1 |
| | C | | | | | | 1 | 1 | 1 | 0 |

The key code KC outputted by the key depression detecting circuit 12 is applied through an automatic base/chord performance control device 13 to a tone production assigning circuit 14. The automatic bass chord performance control device 13 operates to control an automatic bass performance and an automatic chord performance. The device 13 is so designed as to produce an automatic bass tone with reference to the lower keyboard and to produce an automatic chord tone with reference to the pedal keyboard, for instance. When the automatic bass/chord performance is selected, the device 13 operates to automatically form a key code AKC for tones necessary for the bass performance and the chord performance, according to the key code KC representative of a key of the lower keyboard, and to output the key code AKC with suitable timing. Furthermore, the device 13 operates to produce an automatic chord tone gate signal CG in synchronization with the timing of chopping (producing) of the automatic chord tone, and when the automatic chord performance is not effected, produces a normal gate signal NG continuously. That is, the automatic bass/chord performance control device 13 automatically produces the key code AKC for the tone constituting the automatic bass tone and the automatic chord tone as if the keys of the tone constituting the automatic bass tone and the automatic chord tone were depressed at the keyboard 11, and applies the key code AKC thus produced to the tone production assignment circuit 14.

The tone production assignment circuit 14 receives the key code KC from the key depression detecting circuit 12 or the key code AKC from the automatic bass/chord performance control device 13, and assign the tone production of the key (note) represented by the key code to one of the channels corresponding to the maximum number of simultaneous tone production (12 notes, for instance). The tone production assignment circuit 14 has memory positions corresponding to the respective channels, for instance, and operates to store the key code representative of a key in a memory position corresponding to a channel to which the tone production of the key is assigned. The circuit 14 successively outputs the key codes KC stored in the channels as time division multiplexed signals.

Figure 2:
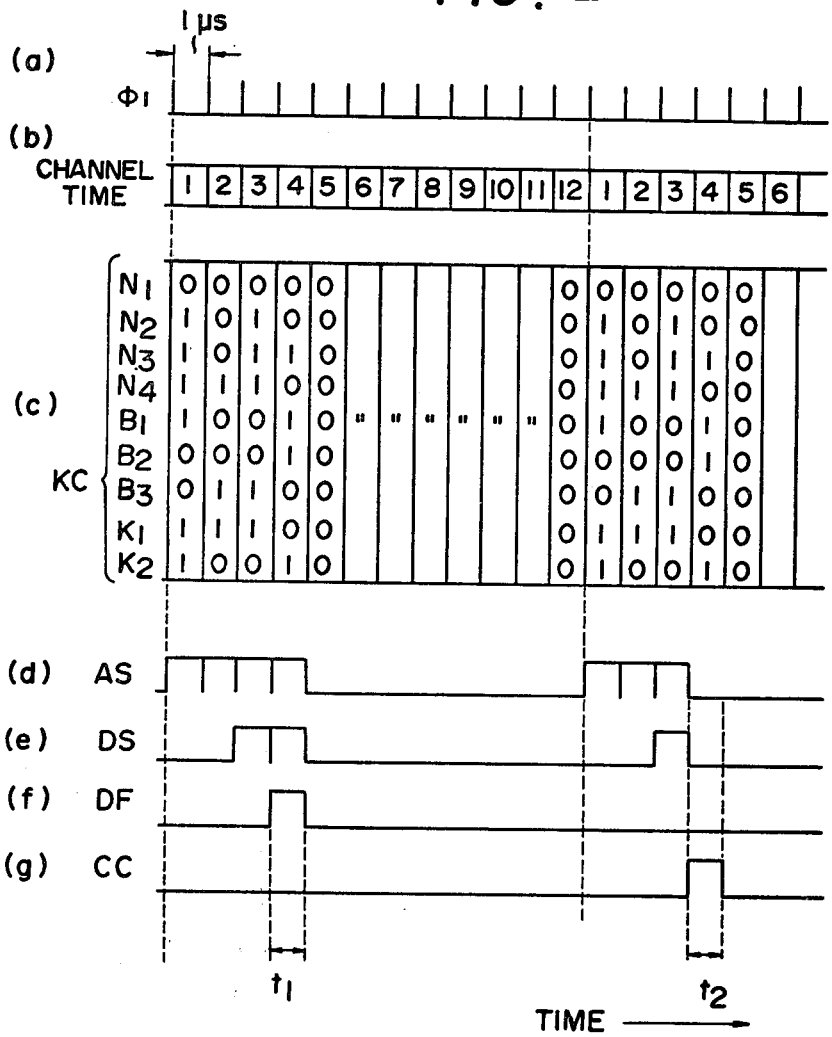
FIG. 2 is a time chart for a description of the time division multiplexed tone production assigning operation of a tone production circuit shown in FIG. 1.

In order to simultaneously produce a plurality of tones, this embodiment is designed in dynamic logic manner so that various counters, logical circuits and memories can be commonly used in a time-sharing manner. Therefore, the time relation of clock pulses controlling the operation of the instrument is very important. The part (a) of FIG. 2 is a graphical representation indicating a main clock pulse $\phi_1$. This main clock pulse $\phi_1$ is to control the time-sharing operations of the channels, having a period of, for instance, one microsecond ($10^{-6}$ second). As the number of the channel is twelve, time slots, each having one microsecond in time width, segregated by the main clock pulses $\phi_1$ correspond to the first through twelfth channels, respectively. As shown in the part (b) of FIG. 2, the time slots will be referred to as the first channel time through the twelfth channel time, respectively, hereinafter. These channel times are cyclically provided. Therefore, the key codes KC representing the keys whose tone productions are assigned by the tone production assignment circuit 14 are outputted in time division in coincidence with the times of the channels to which the keys are assigned. For instance, if it is assumed that the note C in the second octave range of the pedal keyboard is assigned to the first channel, the note G in the fifth octave range of the upper keyboard, to the second channel, the note C in the fifth octave range of the upper keyboard, to the third channel, the note E in the fourth octave range of the lower keyboard, to the fourth channel, and no tone production is assigned to the fifth to twelfth channels, then the contents of the key codes KC outputted in time division and in synchronization with the channel times by the tone production assignment circuit 14 are as indicated in the part (c) of FIG. 2. All of the outputs for the fifth through twelfth channels are "0".

In addition the tone production assignment circuit 14 outputs attack start signals (or key-on signals) AS in time division and in synchronization with the channel times, which represents that the tones of depressed keys should be produced in the channels to which the tone productions of the keys are assigned. Furthermore, the circuit 14 outputs in time-division and in synchronization with the channel times decay start signals (or key-off signals) DS representing that keys whose tone productions are assigned to the channels are released. These signals AS and DS are utilized for the amplitude envelope control (tone production control) of musical tones. Furthermore, the tone production assignment circuit 14 receives a decay finish signal DF from an envelope generator 15, which represents that the tone production in relevant channel has been finished, and according to this signal DF outputs a clear signal to clear various storages concerning the channel and to completely clear the tone production assignment. If it is assumed in the part (c) of FIG. 2 that keys assigned to the first and second channels are being depressed, keys assigned to the third and fourth channels are released whereby the tone production thereof are being decayed, and in the fourth channel the tone production is completed at the time slot $t_1$ to produce the decay finish signal DF and the clear signal CC is provided at the time slot $t_2$ or in twelve channel times, then various signals AS, DS, DF and CC are provided as indicated in the parts (d) through (g) of FIG. 2. As the clear signal CC is outputted at the time slot $t_2$, the attack start signal AS and the decay start signal DS of the fourth channel are cancelled. In this operation, the key code KC for the fourth channel time is also concelled; however it is left as it is, for convenience in description.

The key code KC produced by the tone production assigning circuit 14 is applied to an adress generator 16, whereby variable data XqF varying repeatedly in correspondence to the musical tone frequency of the key represented by the key code KC is obtained in time-division. This variable data XqF is utilized as address data for repeatedly reading the sequential sample point amplitude of a tone source waveform out of a waveform memory.

Figure 3:
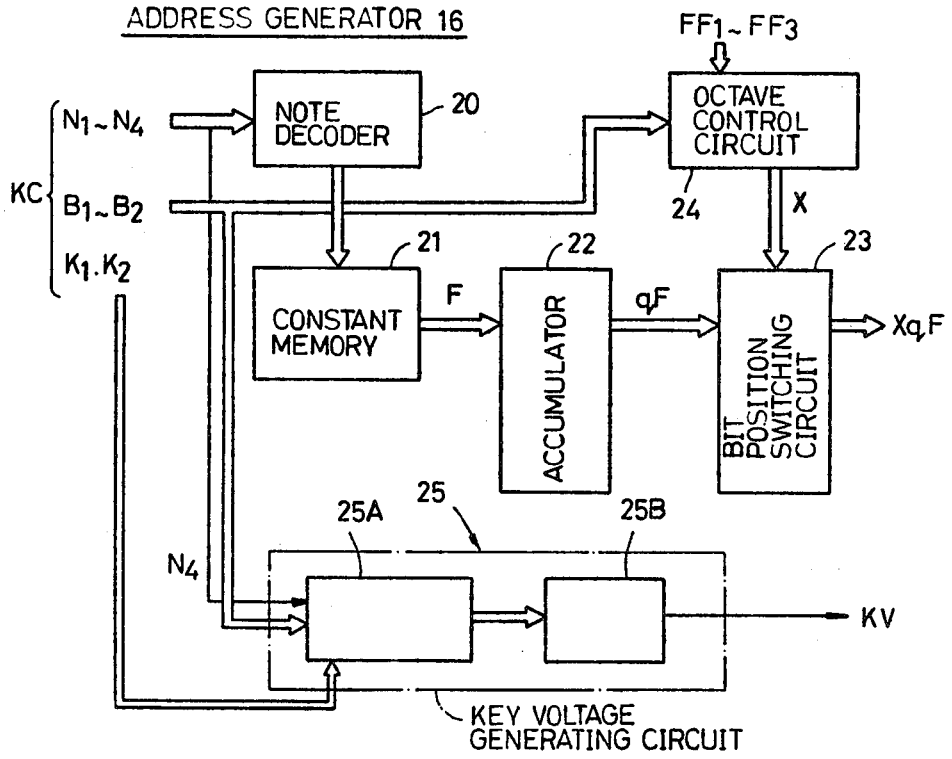
FIG. 3 is a block diagram showing one example of a wave generator shown in FIG. 1.

One example of the adress generator 16 is shown in FIG. 3. Referring to FIG. 3, the note code $N_1$-$N_4$ out of the key code KC supplied by the tone production assigning circuit 14 is applied to a note decoder 20, and a decode output is provided on an output line corresponding to the note represented by the note code $N_1$-$N_4$. A constant memory 21 operates to store constant data F in a binary system in advance, which are proportional to the frequencies of the twelve notes C through B in one octave. In the constant memory 21, the constant data F corresponding to the note represented by the note code $N_1$-$N_4$ is read out according to the output of the note decoder 20. An accumulator 22 operates to repeatedly add the constant data F read out of the memory 21 every regular time interval T to obtain a variable data aF where q is a variable which increase successively as 1, 2, 3, 4 and so on whenever the time interval T passes.

The output qF of the accumulator 22 is applied to a bit positions switching circuit 23 so that its binary digit position is shifted rightward or leftward according to the value of an octave switching data X applied thereto by an octave control circuit 24. In other words, in this circuit 23, the variable data qF which varies regularly according to the note frequencies in one octave is multiplied by the octave switching data X, and the variable data XqF corresponding to the frequencies of the relevant notes in the octave range specified by the octave switching data X is obtained.

The octave switching data X is provided according to the content of the octave code $B_1$-$B_3$. In general, the data X will have a value with which the octave range specified by the octave code $B_1$-$B_3$ can be realized; however, the value of the data X is such that the code $B_1$-$B_3$ is changed according to the value of a feet change data $FF_1$-$FF_5$ to suitably change the octave range. The distance in one octave corresponds to a frequency ratio 2:1. Therefore, if it is assumed that an octave range to which a note stored in the constant memory 21 is the fundamental octave, when the octave range of a note to be produced is higher by n octaves than the fundamental octave, the value of X is $2^n$, and when it is lower by n octaves than the fundamental octave, the value of X is $2^{-n}$. In other words, the relation in frequency between octaves is of the power of two (2). Therefore, it is possible to effect the octave switching control by the bit position switching circuit 23. In this example, the bit position switching circuit 23 is provided at the rear stage of the accumulator 22; however, it may be possible to provide the bit position switching circuit 23 at the front stage of the accumulator 22 to obtain the variable data XqF similarly as in the former case.

The value of the constant data F stored in the constant memory 21 is determined from the frequency f of a relevant tone in the fundamental octave, the number of times N of addition of the same data f in the accumulator 22, and the number of addresses for one period of a tone source waveform stored in a groups of waveform memories 17 through 19. That is, the decimal value of the constant data F is determined according to the following equation (1):

$$F=(f\cdot M)/N \tag{1}$$

The constant data F for the notes obtained according to the equation (1) are converted into binary numbers, and these binary constant data F are stored in the constant memory 21 in advance.

In the variable data XqF, the value of the variable q becomes N in one second. Therefore, the equation (1) can be rewritten as follows:

$$XF=(Xf\cdot M)/N \tag{2}$$

Accordingly, the frequency is switched in proportion to the value of the octave switching data X. As the data X is the power of 2 as was described before, the frequency f is switched with the power of 2 of the frequency f of the fundamental octave. Thus, the frequency of the tone is switched by the octave. That is, the octave range of the tone is selected.

Therefore, if in the bit position switching circuit 23, the bit position of the output data qF of the accumulator 22 is shifted leftward (to a more significant bit), the multiplication of $2^n$ is effected with the data X, as a result of which the octave is raised by the number n of the shifted bit positions. On the other hand, if in the bit position switching circuit 23 the bit position of the output data qF is shifted rightward (to a less significant bit), the multiplication of $2^{-n}$ is effected with the data X, as a result of which the octave is lowered by the number n of shifted bit positions.

In order to accumulate in time division the constant data F which are read out of the constant memory 21 in time-division the accumulator 22 comprises a 12-stage shift register corresponding to the number of channels, and a plural-bit adder for adding the constant F to the preceding calculation result stored in the shift register.

Table 2 blow indicates one example of the contents of the constant data F ($F_1$ through $F_{10}$) corresponding to the notes C# through C stored in the constant memory 21.

Table 2

| | (MSB) | | | Constant data F | | | | | (LSB) | |
|---|---|---|---|---|---|---|---|---|---|---|
| Note | $F_{10}$ | $F_9$ | $F_8$ | $F_7$ | $F_6$ | $F_5$ | $F_4$ | $F_3$ | $F_2$ | $F_1$ |
| C# | 0 | 1 | 1 | 1 | 1 | 0 | 1 | 1 | 0 | 1 |
| D | 1 | 0 | 0 | 0 | 0 | 0 | 1 | 0 | 1 | 0 |
| D# | 1 | 0 | 0 | 0 | 1 | 0 | 1 | 0 | 0 | 1 |
| E | 1 | 0 | 0 | 1 | 0 | 0 | 1 | 0 | 1 | 0 |
| F | 1 | 0 | 0 | 1 | 1 | 0 | 1 | 1 | 0 | 1 |
| F# | 1 | 0 | 1 | 0 | 0 | 1 | 0 | 0 | 1 | 0 |
| G | 1 | 0 | 1 | 0 | 1 | 1 | 1 | 0 | 0 | 1 |
| G# | 1 | 0 | 1 | 1 | 1 | 0 | 0 | 0 | 1 | 0 |
| A | 1 | 1 | 0 | 0 | 0 | 0 | 1 | 1 | 1 | 0 |
| A# | 1 | 1 | 0 | 0 | 1 | 1 | 1 | 1 | 0 | 1 |
| B | 1 | 1 | 0 | 1 | 1 | 0 | 1 | 1 | 1 | 0 |
| C | 1 | 1 | 1 | 0 | 1 | 0 | 0 | 0 | 1 | 0 |

A key voltage generating circuit 25 is provided in the address generator 16. The key voltage generating circuit 25 operates to generate a key voltage (tone pitch voltage) KV for controlling the out-off frequency of a tone color controlling voltage control type filter 26 (FIG. 1) according to the pitch of a produced tone. As is well known in the art, in order to obtain a constant tone color by keeping constant the relation between the harmonic components of the produced tone irrespective of the tone pitch (the fundamental frequency), it is necessary to vary the cut-off frequency according to the pitch of the produced tone. In the electronic musical instrument shown in FIG. 1, the tone source waveforms of plural tones produced in the channel are multiplexed and are applied to one voltage control type filter 26 through a line 27. Accordingly, it is necessary to apply to the voltage control type filter 26 a key voltage KV representative of either of the plural tones. In this example, the key voltage is generated according to the higher-note priority system. However, it is unnecessary to establish priority order for all of the keys. That is, the requirement can be met by dividing the keys into several ranges, and by using a key voltage for a relevant range.

Therefore, the key voltage generating circuit 25 in the example is so designed that the key voltage KV is generated for every half octave to determine the high-tone priority order per half octave. For this purpose, the octave code $B_1$-$B_3$, and the most significan bit data $N_4$ of the note code are applied to the key voltage generating circuit 25. As is apparent from Table 1, the value of the bit $N_4$ is "0" for the first half (C#-F#) of one octave, and is "1" for the second half (G-C) shereof. Accordingly, distinguishment of the half octaves can be effected by the 4-bit data $B_3$, $B_2$, $B_1$, $N_4$. The higher range has a greater value of the data $B_3$, $B_2$, $B_1$, $N_4$. Therefore, determination of the higher-note priority is effected by detecting a channel in which the value of the data $B_3$, $B_2$, $B_1$, $N_4$ is maximal by a maximum value detecting circuit 25A in the key voltage generating circuit 25.

In a distribution circuit 28 in FIG. 1, only the upper keyboard signals are distributed through the line 27 to the voltage control type filter 26. Therefore, the keyboard code $K_1$, $K_2$ is applied to the maximum value detecting circuit 25A, and only the data $B_3$-B $B_1$ $N_4$ relating to the upper keyboard tone is utilized in the maximum value detecting circuit 25A, Analog voltages (key volts) for the range (half octave range) are stored in a key voltage memory 25B, and the key voltage for the highest range detected by the maximum value detecting circuit 25A is read out.

Referring back to FIG. 1, a automatic arpeggio performance control device 29 is adapted to automatically effect a musical performance similar to arpeggio. In this device 29, the key codes for the lower keyboard out of the key codes KC supplied thereto by the tone production assigning circuit 14 are selected in the order of tone pitches for every tone production timing predetermined, and an automatic arpeggio tone production command signal CCP is produced in synchronization with the channel time to which the selected key code KC is assigned. Furthermore, during the operation of the automtic arpeggio performance control device 29, a automatic arpeggio selection signal CPSL is outputted in a direct current mode. When the automatic arpeggio performance control device is operated, the tone of a depressed key in the lower keyboard of the keyboard 11 or the tone concerning the key code ACK for automatic chord performance which is automatically formed by the automatic bass/chord performance control device 13 is automatically produced in arpeggio. In an automatic arpeggio performance employing the automatic arpeggio performance control device 29, the octave of a produced tone can be automatically switched, and the footage change data $FF_1$–$FF_3$ representative of the amount of switching octave is outputted to the adress generator 16 by the device 29. According to the value of the footage change data $FF_1$–$FF_3$, the bit position of the variable data XqF outputted by the address generator 16 is changed, as a result of which a tone in an octave different from the octave specified by the key code KC outputted by the tone production assignment circuit 14 is produced.

Each of the waveform memory groups 17, 18 and 19 comprises a plurality of tone source waveform memories. In these groups, according to the variable data XqF supplied in time-sharing manner by the adress generator 16, various tone source waveform signals of frequencies corresponding to the tones assigned to the channels are read in time-sharing manner and separately according to the channels out of the tone source waveform memories. For instance, the waveform memory group 17 comprises twelve sinusoidal waveform memories (not shown) corresponding to twelve harmonic components ranged from the fundamental wave $SW_1$ to the twelfth harmonic wave $SW_{12}$, and reads sinusoidal waveform signals $SW_1$ through $SW_{12}$ corresponding to the harmonic waves in a parallel mode and in time-sharing manner separately according to the channels.

The waveforms memory group 18 comprises memories in which saw-tooth waveforms as tone source waveforms including a number of harmonic components are stored in advance. For instance, the waveform memory group 18 comprises four saw-tooth waveform memories (not shown) corresponding to 2 foot (2'), 4 foot (4'), 8 foot (8'), and 16 foot (16') registers, and the saw-tooth waveform signals of 2' to 16' are read out in a parallel mode and in time-division separately according to the channels in response to the variable data XqF applied thereto in time division separately according to the channels.

The waveform memory group 19 comprises a plurality of sinusoidal waveform memories and a plurality of saw-tooth waveform memories. For instance, the group 19 comprises two sinusoidal waveform memories for reading an 8 foot sinusoidal waveform signal SW8' and a 16 foot sinusoidal waveform signal SW16', respectively, and two saw-tooth waveform memories for reading an 8 foot saw-tooth waveform signal ST8' and a 16 foot saw-tooth waveform signal ST16', respectively.

In this embodiment, a plurality of systems each comprising the waveform memory groups (17, 18 and 19) for the tone sources are provided in such a manner that the different system store different tone source waveforms, and these tone source waveforms are read out in parallel mode with the aid of the same address data XqF, because musical tones different in tone quality can be produced in different musical tone forming methods. For instance, in the system following the waveform memory group 17, the sinusoidal waveform signals $SW_1$ through $SW_{12}$ are suitably mixed by a harmonic coefficient scaler 30, musical tone colors, especially flute type tone colors are formed by a harmonic synthesizing system. In the system following the waveform memory group 18, the saw-tooth waveform signals are applied to a formant filter section 31 to control the harmonic components, thereby to obtain musical tones with predetermined tone colors.

The system of the waveform memory group 17 will be described. The sinusoidal waveform signals $SW_1$ through $SW_{12}$ are applied to a distribution circuit 32, as a result of which these signals are applied to different lines U1, L1 and P1 separately according to the kinds of keyboard. The keyboard code $K_1$, $K_2$ out of the key code KC provided by the tone production assigning circuit 14 in synchronization with the channel times is representative of the assignment of keyboard tones to the channels. Therefore, by the utilization of this key code $K_1$, $K_2$, distribution of the sinusoidal waveform signals $SW_1$ through $SW_{12}$ is carried out. For instance, in the example shown in the part (c) of FIG. 2, the pedal keyboard tone is assigned to the first channel, and therefore the sinusoidal waveform signals $SW_1$ through $SW_{12}$ read out in synchronization with the first channel time are distributed to the pedal keyboard line P1. Furthermore in the example shown in the part (c) of FIG. 2, the upper keyboard tone is assigned to the second and third channels, and therefore the sinusoidal waveform signals $SW_1$ through $SW_{12}$ read out in synchronization with the second and third channel times are distributed to the upper keyobard line U1. Similarly as in the above-described case, as the sinusoidal waveform signals $SW_1$ through $SW_{12}$ read out in synchronization with the channel times to which the lower keyboard tone is assigned relate to the lower keyboard tone, thses signals are distributed to the lower keyboard line L1. Each of the upper keyboard line U1, the lower keyboard line L1, and the pedal keyboard line P1 which are indicated by the wide lines comprises a plurality of lines for introducing the sinusoidal waveform signals.

The time-shared sinusoidal waveform signals $SW_1$ through $SW_{12}$ which are distributed to the lines U1, L1 and P1 separately according to the kinds of keyboard are applied to the harmonic coefficient scaler 30. The harmonic coefficient scaler 30 comprises a plurality of resistance type mixing circuits in which predetermined harmonic components are multiplied by predetermined amplitude coefficients and are then subjected to mixing thereby to form musical tones having predetermined tone colors. The amplitude coefficient is set by the value of the resistance. For instance, according to the sinusoidal waveform signals $SW_1$ through $SW_{12}$ concerning the upper keyboard which are supplied through the upper keyboard line U1, "a 16 foot flute tone", "an 8 foot flute tone", "a 5⅓ foot flute tone", "a 2⅔ foot flute tone" and "a 2 foot flute tone" are formed in a parallel mode, and these flute tones for the upper keyboard are applied through a line UF to a tone volume section 33. On the other hand, flute tones formed with the aid of the sinusoidal waveform signals $SW_1$ through $SW_{12}$ supplied through the lower keyboard line L1 are applied through a line LF to the tone volume section 33. Bass tones formed with the aid of the sinusoidal waveform signals $SW_1$ through $SW_{12}$ supplied through the pedal keyboard line P1 are applied through a line PF to the tone volume section 33.

The tone volume section 33 comprises tone volumes for selecting the musical tones having various tone colors formed by the harmonic coefficient scaler 30 respectively for the tone colors supplied through the lines UF, LF and PF. The performer can select the flute-system tones formed by the system of the waveform memory group 17. One example of the tone colors which are formed separately according to the kinds of keyboard by the harmonic coefficient scaler 30 and which can be selected by the tone volume section 33 is indicated in Table 3. Flute tones are formed by the systems of the upper and lower keyboards, while base tones are formed by the system of the pedal keyboard.

Table 3

(One example of the tone colors which are applied to the lines UF, LF and PF and which can be selected by the tone volume section 33)

| Upper key-board (UF) | Lower keyboard (LF) | Pedal Keyboard (PF) |
|---|---|---|
| Flute tone | Flute tone | Flute tone |
| 16 foot | | 16 foot |
| 8 foot | 8 foot | 8 foot |
| 5⅓ foot | | |
| 4 foot | 4 foot | |
| 2⅔ foot | 2⅔ foot | |
| 2 foot | 2 foot | |

The output of the tone volume section 33 is subjected to mixing separately according to the kinds of keyboard, and is introduced to an upper keyboard tone output line UFM, a lower keyboard tone output line LFM, and a pedal keyboard tone output line PFM, respectively.

The saw-tooth waveform signals (2'–16') of the channels read in time-division manner out of the waveform memory group 18 are applied to a distribution circuit 28 where according to the contents of the keyboard code $K_1$, $K_2$ the saw-tooth waveform signals (8'–12') concerning the upper keyboard tone, the saw-tooth waveform signals (2'–12') concerning the lower keyboard tone, and the saw-tooth waveform signals (2'–16') concerning the pedal keyboard tone are distributed to an upper keyboard line U2, a lower keyboard line L2, and a pedal keyboard line F2, respectively.

The saw-tooth waveform signals thus distributed are applied to a formant filter section 31 where they are subjected to tone color control as required. The formant filter section 31 comprises a plurality of formant filter having various characteristics for various tone colors, respectively, for the keyboards. The outputs of the formant filters for the upper keyboard, the outputs of the formant filters for the lower keyboard, and the outputs of the formant filters for the pedal keyboard are applied respectively through an upper keyboard line UC, a lower keyboard line LC, and a pedal keyboard line PC to a formant filter system tone volume section 34.

This tone volume section 34 comprises a plurality of tone volumes respectively corresponding to the formant filters in the formant filter section 31. By operating the tone volume section 34, the performer can select the volumes of musical tones formed by the system of the waveform memory group 18 and the formant filter section, as desired. One example of the tone colors which are formed by the formant filter section 31 and which can be selected by the tone volume section 34 is indicated in Table 4 below.

Table 4

| (One example of the tone colors which are formed by the formant filter section 31 and can be selected by the tone volume section 34) | | |
|---|---|---|
| Upper keyboard (UC) | Lower keyboard (LC) | Pedal keyboard (PC) |
| Bassoon 16 foot | Diapason 8 foot | Tuba 16 foot |
| Brass 8 foot | Horn 8 foot | |
| Oboe 8 foot | Cello 8 foot 4 foot | |
| String 8 foot 4 foot | | |

The outputs of the tone volume section 34 are subjected to mixing separately according to the kinds of keyboards, and are then introduced to an upper keyboard output line UCM, a lower keyboard output line LCM, and a pedal keyboard output line PCM, respectively.

Gates 35, 36 and 37, resistors 38 and 39, and an envelope gate 40 provided on a flute-system lower keyboard output line LFM and a formant filter system lower keyboard output line LCM are to effect tone volume control in automatic bass chord performance and in automatic arpeggio performance. In the case of chopping a chord tone in automatic bass chord performance, the automatic chord tone gate signal CG is applied from the automatic bass chord performance control device 13 to the envelope gate 40, whereby an envelope of decaying characteristic is given, in an analog mode, to the musical tone signal introduced by the formant filter system lower keyboard output line LCM, and the musical tone signal is produced as an automatic chord tone. The envelope gate 40 is a circuit which gives an envelope of decay characteristic to a musical tone by utilizing the charge-discharge characteristic of a capacitor, for instance. In the case where no automatic chord tone is produced, the normal gate signal NG continuously outputted by the aforementioned bass chord performance control device 13 is applied to the gate 37 so that the tone of the lower keyboard output line LCM is produced directly (bypassing the envelope gate 40). In the case when no particular tone volume control is effected, a person will hear the decaying tone at a tone volume level lower than that of the continuous tone. Accordingly, when the automatic chord tone is switched over to the continuous tone by application of the normal gate signal NG, an unnatural variation in tone volume is sensed.

In this example, in order to prevent the occurrence of such unnatural variation in tone volume, the resistor 39 for decreasing the level is provided in the path of the gate 37 which is continuously opened by the normal gate signal NG. Accordingly, when compared with the case where the musical tone is produced through the envelope gate 40 opened by the automatic chord tone gate signal CG, the tone volume level in the case where the musical tone is produced through the gate 37 opened by the normal gate signal NG is decreased. Thus, control is effected so that the tone volume level in auditory sense of the automatic chord tone intermittently chopped is substantially equal to that of the continuously conducted tone. Due to the same reason, the resistor 38 for decreasing level is provided in the path of the flute-system lower keyboard output line LFM continuously conducted, so that the tone volume level in auditory sense of the automatic chord tone through the line LCM and the envelope gate 40 is substantially equal to that of the tone of the line LFM.

Tone production of the automatic arpeggio performance is effected by chopping tones one by one in the arpeggio system. Accordingly, similarly as in the case of chopping the automatic chord tone, the audience will feel that its tone volume level is lower than that of the tone continuously conducted. Therefore, the gates 35 and 36 in the line LFM and LCM are opened by the automatic arpeggio selection signal CPSL produced by the automatic arpeggio performance control device 29, thereby to short the paths of the level decreasing resistors 38 and 39. As a result, in the case of the chord pyramid performance, the tone volume level is not decreased by the resistors 38 and 39, and the tone production is effected at a tone volume level higher than that of the continuously conducted tone. The reason why the above-described gates and level decreasing resistors are provided for the lower keyboard output lines LFM and LCM only is that in this example the automatic chrod tone and the automatic arpeggio tone are produced as the lower keyboard tone.

The tone source waveform signals SW8', SW16', ST8' and ST16' read out of the waveform memory group 19 are utilized for forming the tone colors of piano, harpsichord, Hawaiian guitar, and vibraphone. In this example, these tone colors can be selected by the upper keyboard only. Accordingly, the sinusoidal waveform signals SW8' and SW16' and the saw-tooth waveform signals ST8' and ST16' read out of the waveform memory group 19 are selected only at the channel times to which the upper keyboard tones are assigned, in a distribution circuit 41, and these signals are applied to a filter section 42. In other words, according to the contents of the keyboard code $K_1$, $K_2$ outputted in time division from the tone production assigning circuit 14, only the tone source waveform signal SW8'-ST16' concerning the upper keyboard are applied to the filter section 42. This filter section 42 comprises filters for obtaining respectively the tone colors of piano (PLA), harpsichord (HC), Hawaiian guitar (HG) and vibraphone (VIB), and operates to apply the tone color signal PLA through VIB formed according to the tonal source waveform signals SW8' through ST16' to a preset tone selector 43.

The preset tone selector 43 comprises switches for respectively selecting the tones of piano (PLA), harpsichord (HC), Hawaiian guitar (HG) and vibraphone (VIB), and tones desired by the performer are selectively introduced to an output line 44.

The aforementioned various musical tone signals for the upper keyboard supplied to the upper keyboard output line UF of the harmonic coefficient scaler 30 and to the upper keyboad output line UC of the formant filter section 31 are also applied to a combination mixer 45. This combination mixer 45 is a circuit in which the various tones included in the lines UF and UG are mixed in predetermined combinations thereby to form musical tones having intricate tone colors. The combination mixer is so designed as to produce two kinds of tone: a first combination tone COB1 and a second combination tone COB2. A combination-system preset tone selector 46 is provided with switch means for selecting the combination tones (COB1 and COB2, and the combination tone selected is introduced to an output line 47.

The saw-tooth waveform signals 2' through 16' concerning the upper keyboard which are provided on the upper keyboard line U2 by the distribution circuit 28 are applied through the line 27 and a VCF system tone color selection switch 48 to the voltage controlled type filter (VCF) 26. The musical tone signal subjected to tone color control by the voltage controlled type filter 26 is applied to a voltage controlled type amplifier (VCA) 49 where its tone volume envelope is controlled. A VCF control voltage generator 50 operates to generate a control voltage waveform for controlling the filtering characteristic (such as a cutoff frequency) of the voltage controlled type filter 26, according to the upper keyboard key depression signal UKON. Similarly, a VCA control voltage generator 51 operates to generate a control voltage waveform for controlling the gain of the voltage controlled type amplifier 49, according to the upper keyboard key depression signal UKON. Only one system of the voltage controlled type filter 26 and the voltage controlled type amplifier 49 is provided. The nature of the musical tone formed by this system is determined by the kinds of tone source waveform signals to be supplied through the line 27 to the filter 26, the characteristic of the filter 26, and the gain variation characteristic of the amplifier 49. The VCF system tone color selection switch 48 is to select these three elements according to the tone color selected by the performer. In other words, according to the tone color selected by the VCF system tone color selection switch 48, a necessary one out of the tone source saw-tooth waveform signal 2' through 16' is applied to the voltage controlled type filter 26, and a necessary one out of the control voltages provided by the VCF system control voltage generator 50 is applied to the control input of the filter 26, and furthermore a necessary one out of the control voltages provided by the VCA system control voltage generator 51 is applied to the control input of the voltage controlled type amplifier 49.

The tone colors which can be selected by the VCF system tone color selection switch 48 are as indicated in Table 5, for instance.

Table 5

| One example of the tone colors which can be selected by the switch 48 |
|---|
| Trombone, saxophone, guitar, accordion, trumpet, clarinet, banjo, and wahbrass |

The saw-tooth waveform tone source signal concerning the pedal keyboard tone is applied to an envelope gate 52 for bass guitar through the pedal keyboard line P2 of the distribution circuit 28. The gate 52 is opened by the pedal keyboard key depression signal PKON thereby to control, in an analog mode, the amplitude envelope of the tone source signal. For instance, an amplitude envelope is given to the tone source signal by utilizing the charge-discharge characteristic of a capacitor. The envelope controlled tone source signal is applied to a tone color filter 53 for bass guitar whereby a bass guitar tone color is obtained. The performer selects a bass guitar tone with a desired tone volume by operating a tone volume 54 for bass guitar.

The aforementioned upper keyboard key depression signal UKON and the pedal keyboard key depression signal PKON is formed in the envelope generator 15, according to the key code KC (especially keyboard code $K_1$, $K_2$), the attack start signal AS and the decay start signal DS which are supplied from the tone production assignment circuit 14. When a key of the upper keyboard or the pedal keyboard is kept depressed, these key depression signals UKON and PKON become "1" at all times in a direct current mode instead of a time division.

A filter for eliminating time-division clock components is provided at the output side of each of the distribution circuits 28, 32 and 41; however, it is not shown for simplification.

The amplitude envelope of each of the various tone source signals $SW_1$-$SW_{12}$, 2'-16', $SW_8'$-$ST_{16}'$ read out of the waveform memory groups 17, 18 and 19 is controlled by two kinds of envelope waveform signal supplied through output lines X1 and X2 from the envelope generator 15. More specifically, the envelope waveform signal is supplied through the output line X1 to the waveform memory group 17 of flute system and to the waveform memory group 18 of formant filter system, while the envelope waveform signal is supplied through the output line X2 to the waveform memory group 19.

The envelope generator 15 generates in time division the two kinds of envelope waveform separately according to the channels, in response to the key depressions of the tone assigned to the channels, and distributes the envelope waveforms thus generated to the output lines X1 and X2. This envelope generator 15 is so designed as to selectively generate envelope waveforms in various modes. One example of the envelope generator 15 is shown in FIG. 4.

Figure 5:
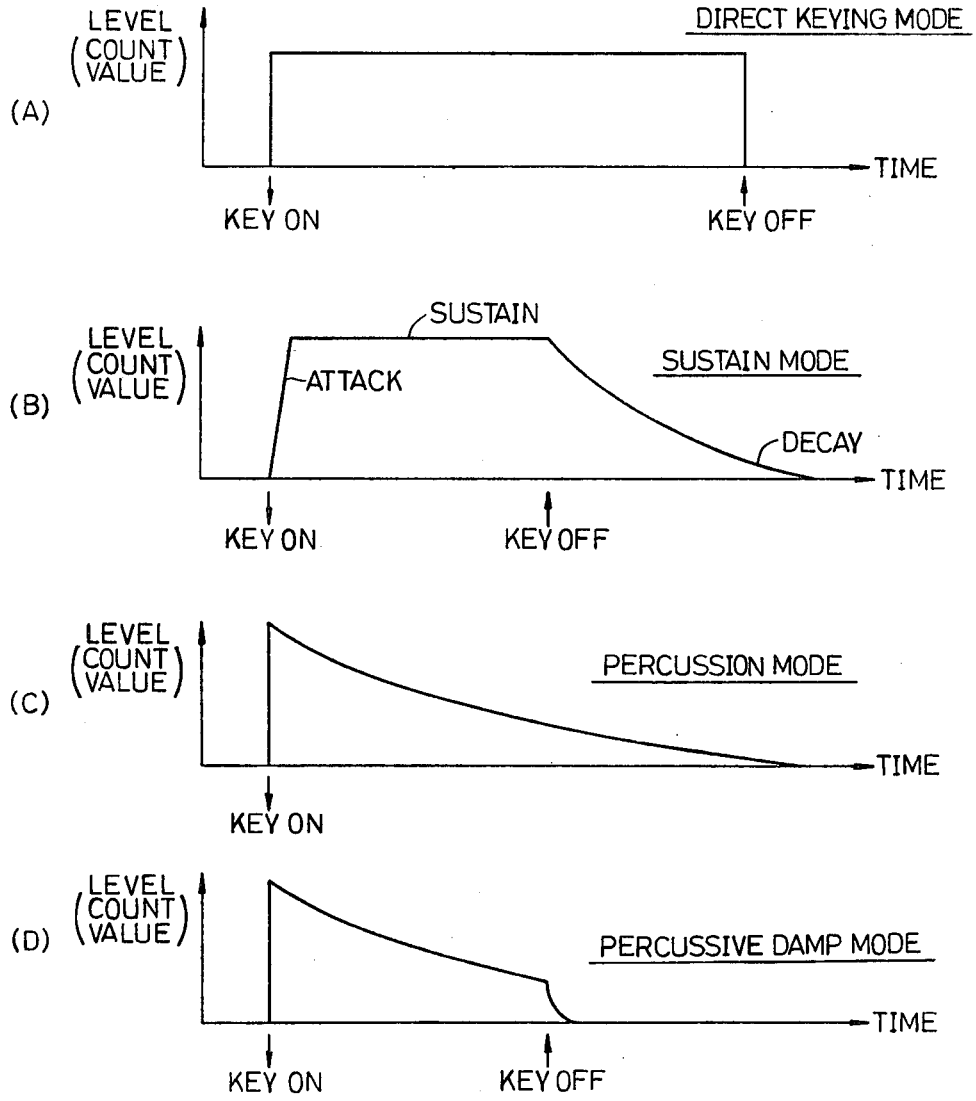
FIG. 5 is a graphical representation indicating various modes of envelope waveforms which can be provided by the envelope generator.

In the envelope generator 15 shown in FIG. 4, a counter 55 is so designed as to carry out its counting operation in time division separately according to the channels, and an envelope waveform signal whose shape is in correspondence to the variation in count value of the counter 55 is generated from the generator 15. In this envelope generator 15, envelope waveforms in four different modes as shown in FIG. 5 can be selectively produced. The part (A) of FIG. 5 shows a direct keying mode envelope waveform whose amplitude is maintained unchanged for the period from key depression start to key release. The part (B) of FIG. 5 shows a sustain mode envelope waveform which consists of an attack part which rises abruptly to the maximum level upon depression of a key a sustain part whose level is maintained unchanged for the period of key depression, and a decay part whose level is gradually decreased to the zero after release of the key. The part (C) of FIG. 5 shows a percussion mode envelope waveform whose level rises to the maximum value upon depression of a key and thereafter decays gradually. The part (D) of FIG. 5 above a percussive damp mode envelope waveform whose level rises to the maximum value upon depression of a key, decays gradually thereafter and decays to zero abruptly upon release of the key. As the level of the envelope to the count value of the counter 55, the attack part of the sustain mode envelope waveform is realized by the addition operation of the counter 55. The decay part or the decay waveforms in the percussion mode and the percussive damp mode are realized by the subtraction operation of the counter 55. The decay waveform will become a waveform having an exponential characteristic in polygonal line approximation by allowing the counter 55 to carry out an approximate exponential calculation.

The attack start signal AS supplied in time-sharing manner from the tone production assignment circuit 14 serves to identify in what channel key depression has been effected. Similarly, the decay start signal DS serves to identify in what channel release has been effected. Furthermore, the ending of the decay can be identified from the fact that the count value of the counter becomes zero (0) when the decay start signal DS is being produced. As a result, the decay finish signal DF is produced by the count value detecting circuit 56. Upon depression of a key, a single attack pulse AP is produced. This pulse AP is applied from the tone production assigning circuit 14 to an envelope generation control logic 57 of the envelope generator 15. In the case of the percussion mode or the percussive damp mode, subtraction from the maximum count value is effected according to the attack pulse AP in the counter 55. The automatic arpeggio tone production command signal CCP from the automatic arpeggio performance control device 29 is employed similarly as in the aforementioned attack pulse AP. This signal CCP is applied through an OR circuit 58 to the envelope generation control logic 57.

In FIG. 4, the count output of the counter 55 is applied to a memory 59 where it is converted into envelope amplitude information having a value corresponding to its count value CV.

The count value of the counter 55 is increased with the aid of the attack clock pulse AC supplied thereto from a clock gate 60 and is decreased with the aid of the decay clock pulse DC supplied thereto from the same. In the case where the exponentially varying decay envelope waveform is obtained by polygonal line approximation, the data of predetermined more significant bits is fed back through a line 61 and a gate 62 to a fraction section counter 63 with the timing of the decay clock pulse DC. A carry signal CR provided as a result of the calculation in the fraction section counter 63 is applied to the addition input of the counter 55. Accordingly, the extent of subtraction by the decay clock pulse DC is changed according to the number of application of the carry signal CR, and the count value CV is changed exponentially.

As the variation with time of the count value CV of the counter 55 corresponds to the shape of the generated envelope, it is possible to generate envelope waveforms having various shapes by controlling the counting operation of the counter 55. The count value detecting circuit 56 operates to detect the fact that the count value of the counter 55 reaches a predetermined value thereby to apply a signal representative of the state of the counter 55 to the envelope generation control logic 57. This envelope generation control logic 57 is a circuit for generating an envelope waveform having a desired shape by controlling the addition and subtraction operations of the counter 55 and also the counting rate, the start and stop time instants of counting operation of the counter 55, and the mode of an envelope waveform is designated by an envelope mode selection signal applied to the envelope generation control logic 57 by an envelope mode selection logic 64. In addition, the shape of the envelope waveform specified by the envelope mode selection signal EM can be further modified in response to a curve selection signal CUS applied to the logic 57.

A clock selection circuit 65 operates to open a clock gate 60 with the aid of the output of the envelope generation control logic 57, whereby one of a plurality of clock pulses supplied from a clock selection gate 66 is applied, as the decay clock pulse DC, or the attack clock pulse AC, to the counter 55. In this example, the attack time or the decay time is made to be different by using the attack clock pulse or the decay clock pulse different according to the kinds of keyboard, even through the envelope shape is identical. Therefore, an upper keyboard/lower keyboard attack clock signal CA, a pedal keyboard attack clock signal CPA, an upper keyboard decay clock signal CUD, a lower keyboard decay clock signal CLD, and a pedal keyboard decay clock signal CPD are individually produced by a clock control circuit 67 (FIG. 1), and are applied through a clock synchronization circuit 68 to the clock selection gate 66. This circuit 68 operates to synchronize the pulse width of each signal CA-CPD aforementioned with one cyclic period (12 microseconds) of all the channel times.

A keyboard detection circuit 69 operates to decode the keyboard code $K_1$, $K_2$ and to output an upper keyboard signal UE, a lower keyboard signal LE or a pedal keyboard signal according to the contents of the keyboard code thus decoded. The keyboard signals UE, LE and PE serve to open, in time division manner, the clock select gate 66 according to their generation time slots, thereby to select, in time division manner, the clock pulses corresponding to the keyboards of the tone assigned to the channels. The selected clock pulses are multiplexed separately according to the attack clock and the decay clock, and are applied to the clock gate 60.

According to envelope function switching data $FU_1$, $FU_2$, $FU_3$, and $FL_1$, $FL_2$, an envelope mode section logic 64 output in time division manner and separately according to the channels the envelope mode selection signal EM corresponding to the function selected by the performer.

The three-bit envelope function switching data $FU_1$, $FU_2$, $FU_3$ is to select the envelope functions of the upper keyboard tone, while the 2-bit envelope function switching data $FL_1$, $FL_2$ is to select the envelope functions of the lower keyboard tone. With respect to the pedal keyboard, only one envelope function is selected at all times and therefore it is unnecessary to provide a particular selecting data. As is apparent from the above description, in this example, it is possible to select and set the envelope functions separately according to the kinds of keyboard. The data $FU_1$, $FU_2$, $FU_3$ and $FL_1$, $FL_2$ are supplied from the envelope control circuit 75 (FIG. 1). The term "envelope function" is intended to mean the combination of envelope modes distributed to the output lines X1 and X2. The envelope function switching data $FU_1$, $FU_2$, $FU_3$ or $FL_1$, $FL_2$ indicates what mode envelope waveform should be distributed to what output line (X1 and X2) in the channels of the upper keyboard tone or the lower keyboard tone. In order to deal with the function switching data $FU_1$--$FU_3$, and $FL_1$, $FL_2$ separately according to the channels, the time division multiplexed keyboard signals UE, LE and PE are applied to the envelope mode selection logic 64 and the envelope function decoder 70.

The envelope waveforms variable with time shown in the parts (B), (C) and (D) of FIG. 5 are produced by the system of the counter 55 and the memory 59 under the control of the envelope generation control logic 57. The envelope waveform or direct keying waveform as shown in the part (A) of FIG. 5 is generated by the system of a direct keying waveform generation series decoder 71 and a direct keying waveform generating section 72. It goes without saying that in generating the direct keying waveform only, the counter 55 and the memory 59 may be employed.

The envelope function decoder 70 operates to decode in time division the function switching data including the direct keying mode thereby to apply its decoded output to the decoder 71. The direct keying waveform generation series decoder 71 is so designed to provide outputs $O_1$ and $O_2$ to the output lines X1 and X2. More specifically, the decoder 71 produces the direct keying waveform selection signals ($O_1$ and $O_2$) in correspondence to the systems (the output lines X1 and X2) which are to produce the direct keying mode envelope waveform in the function decoded by the envelope function decoder 70.

The direct keying waveform generating section 72 operates to generate the direct keying mode envelope waveform in the system X1 or X2 to which the direct keying waveform selection signal $O_1$ or $O_2$ is supplied. In the system X1 and X2 corresponding to the selection signals $O_1$ and $O_2$, the direct keying waveform (part (A) of FIG. 5) of a constant level is produced for the period of from the production of the attack start signal AS to the production of the decay start signal DS, or the period of from the key depression to the key release.

The memory output distributing gate 73 is to distribute the envelope waveform signals read out of the memory 59 to the systems X1 and X2 where no direct keying waveform selection signals $O_1$ and $O_2$ are provided. For instance, in the case where the direct keying mode envelope waveform is provided in the system X1 and the percussion mode envelope waveform is provided in the system X2, the percussion mode envelope waveform is produced by the system of the counter 55 and the memory 59; in this case the gate 73 operates to distribute this envelope waveform to the system X2.

A direct current forming circuit 74 operates to convert the time division multiplexed keyboard signals UE—PE into direct currents. The aforementioned upper keyboard key depression signal UKON and pedal keyboard key depression signal PKON can be obtained by converting the signals Ue and PE into direct currents by this circuit 74, respectively.

The frequency of the decay clock signal CUD relating to the upper keyboard out of the various clock signals CA—CPD provided by the clock control circuit 67, and the contents of the envelope function data $FU_1$, $FU_2$, $FU_3$ relating to the upper keyboard provided by the envelope control circuit 75 can be switched in association with the operating conditions of the preset tone selector 43, the combination series preset tone selector 46 and the VCF series tone color selection switch 48.

The musical tone of the upper keyboard subjected to tone color control through the voltage control type filter 26 is subjected to conduction/non-conduction control according to the operating conditions of the preset tone selector 43 and the combination series preset tone selector 46 in the gate 76. In addition, the musical tones of the upper keyboard outputted through the upper keyboard output lines UFM and UCM from tone volume sections 33 and 34 are subjected to conduction/non-conduction control according to the operating conditions of the preset tone selector 43 or the combination system preset tone selector 46 or the VCF system tone color selection switch 48 in the gates 77 and 78.

The clock control circuit 67, the envelope control circuit 75, and the gates 76, 77 and 78 are controlled according to the operating conditions of the preset tone selectors 43 and 46 and the VCF series tone color selection switch 48. The reason for this is that priority order is decided for the systems of forming the upper keyboard tones so that the musical tones are produced in accordance with the priority order thus decided.

In this connection, the systems of forming the upper keyboard tones are divided into three parts, or three systems, for instance, for which priority order is decided. For instance, the system of upper keyboard tone of from the waveform memory group 17 to the tone volume section 33 and the system of upper keyboard tone of from the waveform memory group 18 to the tone volume section 34 are handled as one system, which will be referred to as "a tone volume system" hereinafter. In this tone volume system, tone colors such as indicated in Table 3 or Table 4 can be selected by the operation of the tone volume in the tone volume section 33 or 34. Furthermore, the system of the combination mixer 45 and the combination-system preset tone selector 46 are regarded as a conbination system, and the system extending from memory group 19 through the filter section 42 to the preset tone selector 43 are regarded as a piano system. The combination system and the piano system are handled as one system which will be referred to as "a preset system". In addition, the system including the voltage control type filter 26 will be referred to as "a VCF system".

Thus, the systems of forming the upper keyboard tones are sorted out into three systems: the tone volume system, the preset system, and the VCF system. In this example, the priority order is established in the order of the preset system, the VCF system, and the tone volume system, the preseting system having the first priority. In this case, the systems employed for producing musical tone are automatically switched as indicated in Table 6. In Table 6, the mark X indicates the fact that a tone selecting operation is carried out in the tone volume sections 33 and 34, or the preset selectors 43 and 46, or the VCF-series tone color selection switch 48, and the mark O indicates a system used for producing musical tones. In addition, in Table 6, "ensemble" is intended to mean a case where the priority order is cancelled.

Table 6

X .... Tone selection
O .... Tone production

| | | Preset system | | VCF system | Tone volume system |
|---|---|---|---|---|---|
| Tone production state in | 1 | X | O | X | X |
| | 2 | X | O | X | |

Table 6-continued

| | | X .... Tone selection<br>O .... Tone production | | | | | |
|---|---|---|---|---|---|---|---|
| | | Preset system | | VCF system | | Tone volume system | |
| priority order | 3 | X | O | | | X | |
| | 4 | | | X | O | X | |
| | 5 | | | | | X | O |
| Ensemble | $EN_1$ | X | O | X | O | X | O |
| | $EN_2$ | | | X | O | X | O |

As is apparent from States 1 through 3 in Table 6, when a tone is selected in the presetn system having the first priority the preset system ony is used for musical tone production, even if tones are selected in the VCF system and the tone volume system. Therefore, when a tone is selected by the preset tone selector 43 or the combination-series preset tone selector 46, the gates 77 and 78 of the tone volume system provided in the upper keyboard output lines UFM and UCM and the gate 76 of the VCF system are controlled to be non-conductive. As a result, tones formed by the preset system are produced, the tone production in the VCF system or the tone volume system is prohibited. For instance, the gates 76, 77 and 78 are made up of electronic switches such as field-effect transistors, and are so designed that when the tone selection switch is closed in the preset tone selector 43 or 46, gate control signals are applied to the electronic switches.

The VCF system is higher in priority order than the tone volume system. Therefore, when tone selection is effected in both of the systems as in State 4 in Table 6, tone production is effected in the VCF system only while tone production in the tone volume system is prohibited. Therefore, when a tone (tone color) is selected by the VCF-series tone color selection switch 48, the gates 77 and 78 of the tone volume system as indicated by the broken line extending from the VCF-series tone color selection 48 to the gates 77 and 78 are controlled to be non-conductive, respectively.

In the case of selecting ensemble, tones in the various systems are produced simultaneously according to the selection in all of the tone volume sections 33 and 34, the tone selectors 43 and 46, and the tone color selection switch 48 an in one example in Table 6. In order to realize such ensemble, an ensemble switch is provided in the system having the highest priority. For instance, in the preset system having the highest priority, a full ensemble (first ensemble) switch ($EN_2$) is provided in association with the preset tone selectors 43 and 46. In the VCF system having the next priority a second emsemble switch ($EN_2$) is provided in the VCF-series tone color selection switch 48. When this full ensemble switch $EN_1$ is operated, the gate 76 of the VCF system and the gates 77 and 78 of the tone volume system are made conductive. When the second ensemble switch $EN_2$ is operated, the gates 77 and 78 are made conductive.

Figure 6:
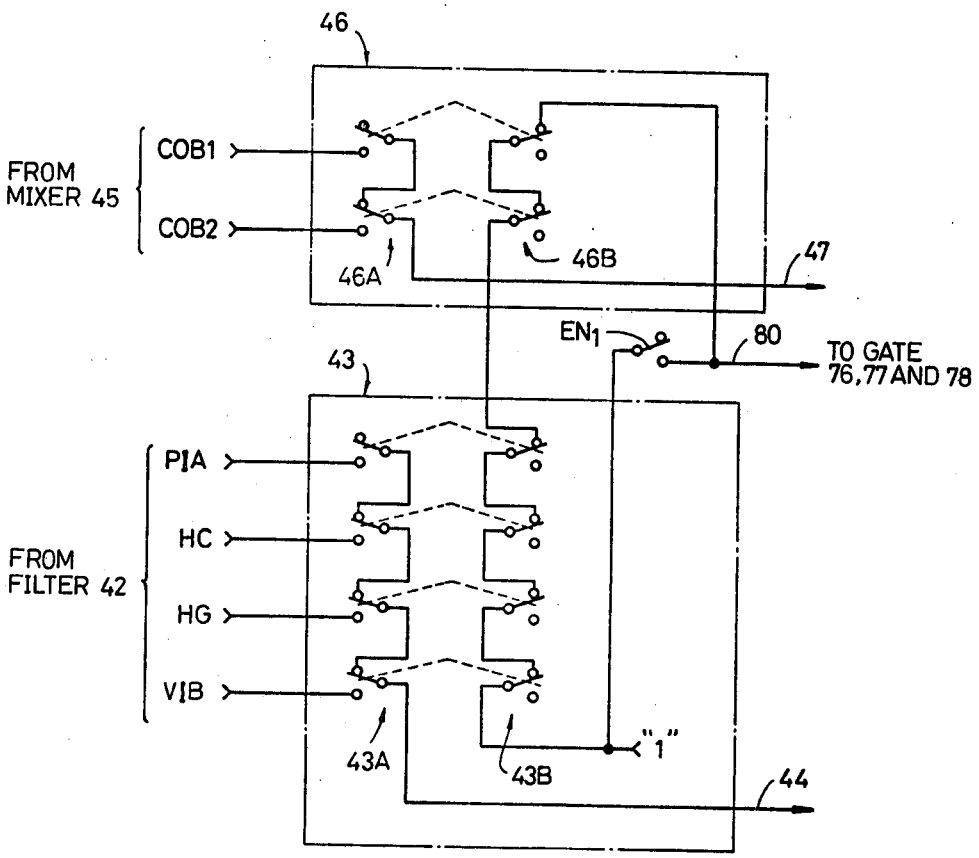
FIG. 6 is a circuit diagram illustrating one example of a preset tone selector, for a description of one example of the relation between various tone color selecting switches and an ensemble switch.

As conductive to a full understanding of the relationships between the ensemble switch and the other tones (tone color) selection switches, the preset tone selector 43 and 46 are shown in FIG. 6 by way of example. The preset tone selectors 43 and 46 comprise tone selection switches 43A and 46A for selecting the piano tone signal PIA, harpsichord tone signal HC, Hawaiian guitar tone signal HG and vibraphone tone signal supplied from the filter section 42 and the first combination tone signal COB1 and second combination tone signal COB2 supplied from the mixer 45, respectively. The tone signals selected by these tone selection switches 43A and 46A are applied through output lines 44 and 47 to the output section 79 (FIG. 1). Priority control switches 43B and 46B are operated in association with the tone selection switches 43A and 46B corresponding to the tone colors, respectively. When the switches 43A and 46A corresponding to optional tones are switched in response to tone selection, the signal level on the line 80 becomes "0", as a result of which the gates 76, 77 and 78 are made non-conductive. This signal of the line 80 is employed as the gate control signal of the gates 76, 77 and 78. Upon operation of the full ensemble switch $EN_1$ the switch $EN_1$ is switched, and the signal "1" is supplied to the line 80. As a result, the gates 76, 77 and 78 are made conductive.

The second ensemble switch $EN_2$ (not shown) is provided in the VCF-series tone color selection switch 48 in relation to the tone selecting switch in accordance with the circuit shown in FIG. 6, so as to control the gates 77 and 78.

If the tone volume system having the lowest priority, musical tones are produced only when no tone is selected in the tone selectors 43 and 46 of the preset system or in the tone color selection switch 48 of the VCF system or when the ensemble switches $EN_1$ and $EN_2$ are operated.

The following performances for instance can be effected by by the priority control or the emsemble control of the musical tone forming systems: When the performance of the keyboard (upper keyboard) 11 is effected by selecting tones (tone colors) with the tone volume section 33 or 34 only, the tone of the tone volume system is produced. When a tone is selected by the preset tone selector 43 with the tone volume setting effected by the tone volume section 33 or 34 left as it is, the tone of the tone volume system is automatically eliminated, and only the tone of the preset system is produced. If the switching operation concerning the tone selected by the preset tone selector 43 is left as it is and the full ensemble switch $EN_1$ is closed, the tone of the tone volume system selected by the tone volume section 33 or 34 and the tone of the preset system by the preset tone selector 43 are produced simultaneously.

The envelope for setting the variation with time of the tonal volume of a produced tone is determined by an envelope waveform provided by the envelope generator 15. In this example, the envelope generator 15 can generate various envelope waveforms such as those in a sustain mode (B), a percussion mode (C) and a percussive damp mode (D) as shown in FIGS. 4 and 5, whose amplitude is changed with time; however, it should be noted that the envelope generator 15 can selectively generate one kid of envelope waveform for one channel (or one key depression). If necessary, it can generate an envelope waveform in a direct keying mode together with one of these envelope waveforms whose amplitudes are changed with time. In other words, it is impossible for the envelope generator 15 to generate envelope waveforms which are different in shape and variable with time (such as the sustain mode waveform and the percussion mode waveform) in the same channel at the same time. On the other hand, the tonal volume envelope featuring the tonal quality of a flute tone or an oboe tone provided by the tone volume system is a sustain tone series envelope (in the sustain mode or in the direct keying mode), and the tone volume envelope featuring the tone quality of a piano tone or a harpsichord tone is a decaying tone series envelope (in the percussion mode or in the percussion mode or in the persussive damp mode). Therefore, the envelope waveform of the sustain mode preferably should be applied to the envelope generator output line X1 through which the envelope waveform is applied to the waveform memory groups 17 and 18 adapted to generate the tone source signals of the tone volume system, while the envelope waveform of the percussion mode or the percussion damp mode should be applied to the envelope line X2 of the waveform memory group 19 adapted to generate the tone source signals such as piano tones. However, it is impossible for the envelope generator 15 to generate different envelope waveforms whose shapes are varied with time, at the same time and to supply them respectively to the lines X1 and X2, as was described above. Accordingly, it is necessary that when the musical tone forming systems generating the upper keyboard tones in accordance with the aforementioned priority order are switched automatically, the modes of the envelope waveforms generated by the envelope generator 15 (the envelope waveforms generated by the system of the counter 55 and the memory 59) are switched. For this reason, the clock control circuit 67 and the envelope control circuit 75 are so designed as to operate in association with the operating conditions of the preset tone selector 43 and 46, and the VCF-series tone color selection switch 48 thereby to automatically switch the modes of the envelope waveforms generated by the envelope generator 15.

Envelope mode switching will be described with reference to one example of the envelope control circuit 75 shown in FIG. 7. The upper keyboard envelope functions data $FU_1$, $FU_2$ $FU_3$ outputted by the envelope control circuit 75 is applied to the envelope generator 15 (FIG. 4), and an envelope waveform in a predetermined mode is generated through its output lines X1 and X2. Indicated in Table 7 are relationships between the values of the envelope function data $FU_1$-$FU_3$ applied to the envelope generator 15 and the modes of the envelope waveforms outputted through the output lines X1 and X2 in response to these values. In Table 7, reference character A designates a direct keying mode as shown in the part (A) of FIG. 5; reference character B, a sustain mode such as shown in the part (B) of FIG. 5; reference character C, a percussion such as shown in the part (C) of FIG. 5; and reference character D, a percussive damp mode such as shown in the part (D) of FIG. 5.

Table 7

| Function No. | $FU_1$ | $FU_2$ | $FU_3$ | X1 | X2 |
|---|---|---|---|---|---|
| 1 | 1 | 1 | 0 | A | C |
| 2 | 0 | 1 | 0 | A | D |
| 3 | 1 | 0 | 0 | B | — |
| 4 | 0 | 0 | 0 | A | — |
| 5 | 1 | 1 | 1 | C | C |
| 6 | 0 | 1 | 1 | D | D |

Figure 7:
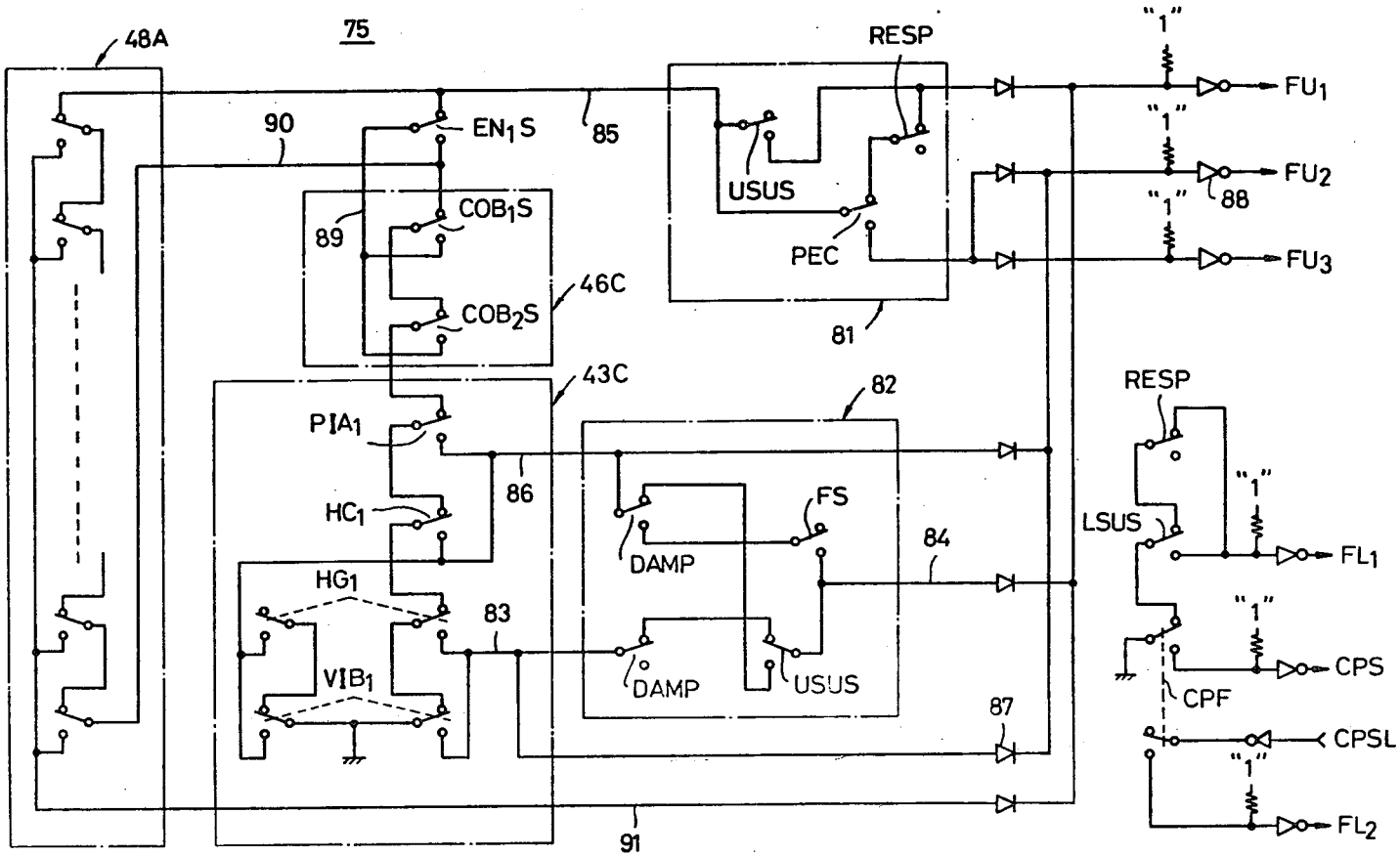
FIG. 7 is a circuit diagram illustrating one example of an envelope control circuit.
Figure 8:
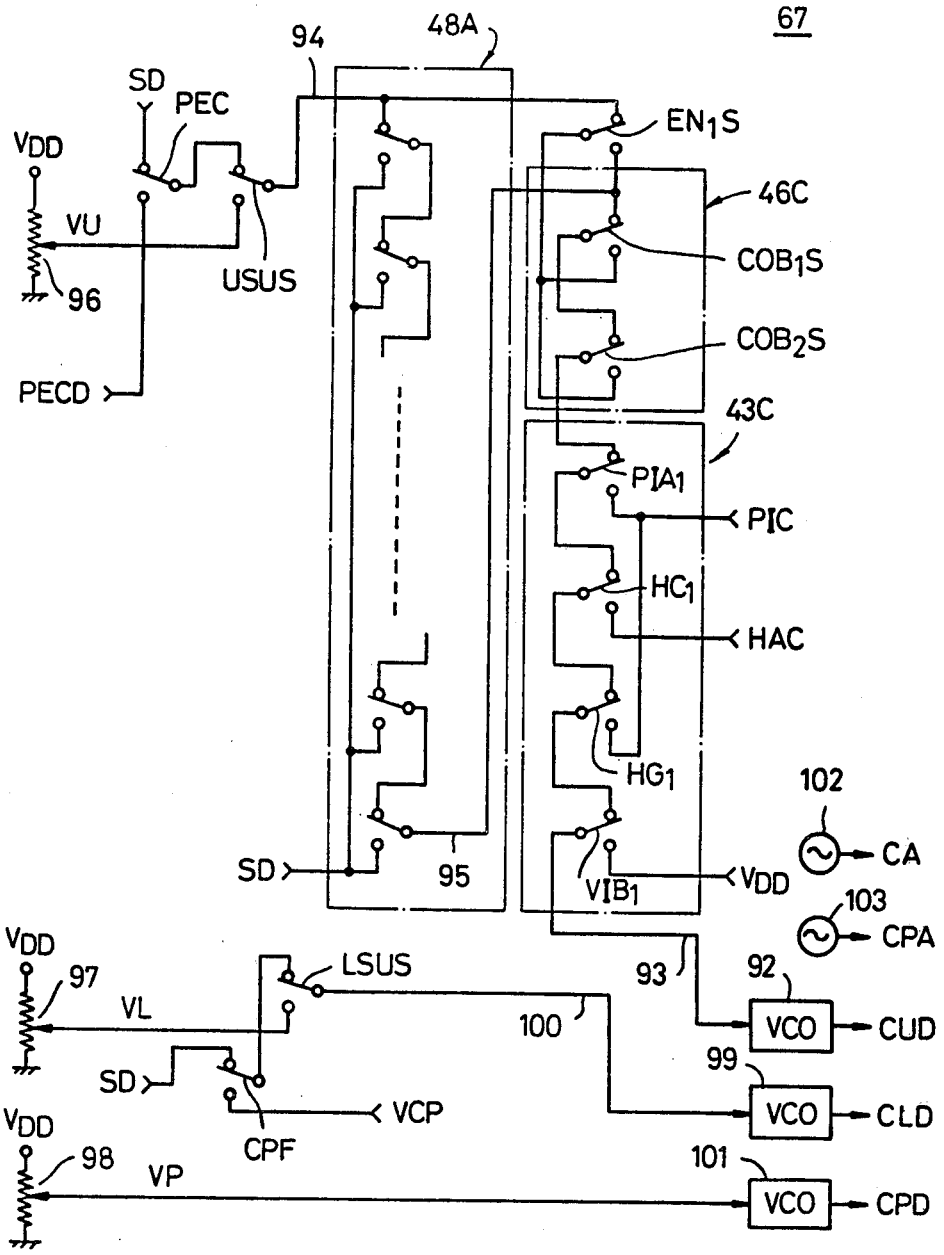
FIG. 8 is a circuit diagram showing one example of a clock control circuit concerning the envelope generator.

Referring to FIG. 7, a preset tone selector switch group 43C operates in association with the switches corresponding to various tone colors in the preset tone selector 43 shown in FIGS. 1 and 6. A combination tones in the combination-system preset tone selector switch group 46C also operates in association with the switches corresponding to various combination tone in the combination-system preset tone selector 46 shown in FIGS. 1 and 6. A VCF-system tone color selecting switch group 48A operates in association with the switches corresponding to various tone colors in the VCF-system tone color selection switch 48 shown in FIG. 1. A full ensemble switch $EN_1S$ operates in association with the full ensemble switch $EN_1$ shown in FIG. 6. These switches are connected in priority order as shown in FIG. 7; that is, priority order is established so that selection of a single tone color is effected even in the same system (the preset system or the VCF system). In accordance with this priority order, the envelope function data $FU_1$-$FU_3$ concerning a selected tone is provided. In FIGS. 7 and 8 (described later), the switches having identical reference characters are operated simultaneously.

In addition to the priority order established among the various systems aforementioned, factors set by a switch section 81 or 82 are employed to control the envelope. One of the factors is a function called "percussive decay". Upon operation of a percussive decay switch PEC selecting this function, the sustain type envelope (of the sustain mode B or of the direct keying mode A) which has been outputted throuth the output lines X1 and X2 of the envelope generator 15 is switched over to the decay type envelope (of the percussion mode C or of the percussive damp mode D).

Another factor is a function called "flute response". Upon operating of a flute response switch RESP selecting this function, the duration of the decay part of the envelope after key release is increased, and the duration of the decay part can be varied. These functions (the percussive decay, flute response and sustain controls) contribute to improvement of the performance in that the performer can provide tones as desired.

A damp switch DAMP is used when the percussion mode envelope is switched over to the percussive damp mode envelope. A foot switch FS is operated by the performer's foot. By operating this switch, the percussive damp mode is changed into the percussion mode.

In the preset tons selector switch group 43C, a not having the first priority is "vibrahone; and a note having the next priority is "Hawaiian guitar". When a vibraphone selecting switch $VIB_1$ or Hawaiian guitar selecting switch $HG_1$ is turned on, a line 83 is brought to ge at the ground voltage (signal "0") and the level of the data $FU_2$ is raised to "1" through a diode 87 and an inverter 88. The signal "0" is applied to a line 84 through the normally open damp switch DAMP and a sustain control switch USUS, as a result of which the data $FU_1$ is raised to "1". When the switch group 43C is operated, a line 85 is in a floating state (signal "1"), and the level of the data $FU_3$ is "0". Accordingly, the data $FU_1$-$FU_3$ is "110", and the envelope function of Function No. 1 in Table 7 is specified. As a result, the percussion mode envelope waveform is applied to the output line X2 of the envelope generator 15, and the percussion mode envelope is given to the vibraphone tone or the Hawaiian guitar tone. Upon operation of the damp switches DAMP, the level of the signal of the line 84 is raised to "1", and the level of the data $FU_1$ is switched to "0". Therefore, the envelope function is changed to the envelope function of Function No. 2 in Table 7, and the percussive damp mode envelope waveform is provided through the output line X2 of the envelope generator 15. If the foot switch FS is closed under this condition, the level of the signal of the line 84 is changed to "0" while the level of the data $FU_1$ is changed to "1", as a result of which the waveform mode of the output line X2 is changed to the percussion mode one.

If the piano selection switch $PIA_1$ or the harpsichord selection switch $HC_1$ is operated, the level of the signal of a line 86 is changed to "0", while the level of the signal of the line 83 is changed to "1". It goes without saying that in this case it is assumed that the switches $HG_1$ and $VIB_1$ higher in priority order are not operated. The data $FU_2$ has thus the level "1", while the line 84 is in a floating state. Therefore, the data $FU_1$ will have the level "0". Accordingly, the function of Function No. 2 is specified, and the percussive damp mode envelope waveform is provided through the output line X2 of the envelope generator 15. Upon operation of the sustain control switch USUS, the level of the signal of the line 84 is changed to "0" through the line 86, the damp switch DAMP in off state, and the switch USUS in on state, while the level of the data $FU_1$ is raised to "1", as a result of which the envelope of the percussion mode C is produced. Simiarly, upon operation of the damp switches DAMP and the foot switch FS, the percussive damp mode is switched over to the percussion mode.

In Function Nos. 1 and 2 described above, the envelope waveform of the direct keying mode A is supplied to the output line X1 of the envelope generator 15. Therefore, when the full ensemble switch $EN_1$ ($EN_1S$) is operated, tonal source signals to which direct keying mode envelopes are given are supplied to the tone volume system and the VCF system utilizing the tonal source signals provided by the waveform memory groups 17 and 18. In the case when a first combination tone selection switch $COB_1S$ or a second combination tone selection switch $COB_2S$ in the combination-series preset tone selector 46C is operated, but the switches in the switch group 43C higher in priority order are not operated, the level of the signal of the line 85 becomes "0". If under this condition, the switches in the switch section 81 are not operated, the data $FU_1$, $FU_2$ and $FU_3$ are respectively at "1", "0" and "0", and Function No. 3 in Table 7 is specified. Accordingly, the envelope of the sustain mode B is applied to the output line X1 of the envelope generator 15. In this operation, the envelope of the direct keying mode A may be supplied to the output line X2; however such a supply is unnecessary in this example because no tone is selected in the system of the waveform memory group 19.

If only the flute response switch RESP is operated when the signal of the line 85 is at the "0" level, all of the data $FU_1$-$FU_3$ are set to the "0" level, and therefore the envelope function of Function No. 4 is specified. Accordingly, the mode of the envelope of the line X1 is changed from the sustain mode B to the direct keying mode. This flute response function is utilized for making steep the rising of a continuous tone such as a flute tone.

If the percussive decay switch PEC is operated when the level of the signal of the line 85 is "0", the level of the data $FU_3$ is raised to "1", which means that the percussive decay function is selected. If in this case the sustain control switch USUS is open, the data $FU_1$ is "0" while the data $FU_2$ and $FU_3$ are "1" and "1", respectively, and therefore the function of Function No. 6 in Table 7 is specified. As a result, the envelopes on the output lines X1 and X2 of the envelope generator 15 have the percussive damp mode. When the switch USUS is turned on, the data $FU_1$ is changed to "1". Therefore, all of the data $FU_1$ through $FU_2$ are now "1", "1" and "1", respectively, and therefore Function No. 5 in Table 7 is specified. As a result, the modes of the envelopes on the output lines X1 and X2 are changed to the percussion mode C.

When the full ensemble switch $EN_1S$ is turned on, the line 89 is connected to the line 90, and the signal level of the line 85 is determined according to the conditions of the VCF-series tone color selection switch group 48A. When any one of the switches in this switch group 48A is turned on, the line 85 is brought to be in a floating state. If no tone is selected by the VCF system, the signal level of the line 85 becomes "0" to operate the switch section 81.

When a switch in the VCF system tone color selection switch group 48A is turned on, the signal "0" from the line 90 is introduced into the line 91, and the data $FU_1$ becomes "1". In this case, as the other data $FU_2$ and $FU_3$ are "0" and "0", respectively, the function of Function No. 4 in Table 7 is specified. However, as the switch group 81 is not operated, the "flute response", "percussive decay" and "sustain control" are not carried out.

In the case where no tone selection is carried out in the VCF system and the preset system, tone production can be effected in the tone volume system having the lowest priority. As all of the switch groups 43C, 46C and 48A and the switches $EN_1S$ are in off state, the ground voltage is introduced into the line 85, and the switch section 81 is enabled. Accordingly, as was described before, the envelope functions of Function Nos. 3 through 6 are selected.

One example of the clock control circuit 67 is shown in FIG. 8. In the circuit 67, the frequency of the upper keyboard decay clock signal CUD is switched according to the aforementioned priority order. In the circuit 67, the preset tone selector switch group 43C, the combination-system preset tone selector switch 46C, the full ensemble switch $EN_1S$ and the VCF system tone color selection switch group 48A operating in association with the switches having like reference characters in FIG. 7 are priority-connected in accordance with the predetermined priority order with the bivraphone selection switch $VIB_1$ having the first priority.

The frequency of the upper keyboard decay clock signal CUD serves to determine the decay speed (decay time) of the decay part (cf. the part (B) of FIG. 5) after key releases in the sustain mode envelope waveform, to determine the decay speed over the whole decay envelope in the percussion mode, and to determine the decay speed of the decay envelope part for the period of time of from the key depression to the key release in the percussive damp mode envelope waveform. In other words, when the above-described envelope parts with respect to the upper keyboard tones are formed in the envelope generator 15, the decay clock pulses DC corresponding to the decay clock signal CUD are utilized for counting in the counter 55.

In FIG. 8, the upper keyboard decay clock pulse signal CUD is oscillated by a voltage controlled type oscillator (VCO) 92, and the oscillation frequency is controlled according to the control voltage supplied to the line 93. Upon selection of the vibraphone selection switch $VIB_1$ having the first priority, a highest decay time voltage $V_{DD}$ (for instance −15 volts) is supplied to the line 93. Upon selection of the Hawaiian guitar selection switch $HG_1$ or the piano selection switch $PIA_1$, a piano tone decay voltage PIC is introduced into the line 93. Of course, this is under the conditions that the switches higher in priority order are in off state. Upon operation of the harpsichord selection switch $HC_1$, a harpsichord decay voltage HAC is introduced into the line 93. The frequency of the decay clock signal CUD is switched according to the voltage PIC or HAC. In the case where the decay clock signal CUD is controlled by these voltages $V_{DD}$, HAC and PIC, the envelope produced through the output line X2 of the envelope generator 15 is of the percussion mode or of the percussive damp mode.

When all of the switches in the preset tone selector switch group 43C are off, and the first combination tone selection switch $COB_1S$ or the second combination tone selection switch $COB_2S$ is operated, the voltage provided on the line 94 is introduced into the line 93 through the full ensemble switch $EN_1S$ in off state. Upon operation of the full ensemble switch $EN_1s$, a voltage according to the condition of the VCF system tone color selection switch group 48A is introduced into the line 93 through the line 95, the full ensemble switch $EN_1S$ in on state, the combination tone selection switch $COB_1$ S or $COB_2S$ in on state, and the preset tone selector switch group 43C.

When any one of the switches in the VCF system tone color selection switch group 48A is operated, the short decay voltage SD is delivered to the line 95. When all of the swithces in the switch group 48A are off, the voltage on the line 94 is delivered to the line 95. When the voltage controlled type oscillator 92 is controlled with the short decay voltage SD, the frequency of the decay clock signal CUD is rendered highest, the duration of the decay part of the sustain mode envelope waveform becomes shortest.

In the case when the sustain control switch USUS and the percussive decay switch PEC are not operated, the short decay voltage SD is introduced to the line 94. When the sustain control switch USUS is operated, the decay voltage VU provided by the variable resistor 96 for controlling the upper keyboard decay time is delivered to the line 94. Accordingly, if the variable resistor 96 is operated to change the decay voltage VU, the time (decay speed) of the decay part (cf. the part (B) of FIG. 5) of the sustain mode envelope waveform can be varied. In the case when the switch USUS is off, the time of the decay part is firxed short (decaying quickly) by the aforementioned short decay voltage SD.

Upon operation of the percussive decay switch PEC, a predetermined percussive decay voltage FECD is delivered to the line 94. This voltage PECD is to set the decay time of the percussion system envelope waveform generated by the envelope generator 15 according to the percussive decay function.

The control voltage of the decay clock signal CUD concerning the musical tones of the tone volume system having the lowest priority is the voltage on the line 94, and is introduced to the line 93 when all of the switch groups 43C 46C and 48A are in off state.

Connection is so made that when both of the sustain control swtich USUS and the percussive decay switch PEC are operated, the switch USUS takes precedence, and therefore the variable decay voltage VU is delivered to the line 94.

The switching of the envelope modes and the switching of the decay clock frequency control voltages in the circuits shown in FIGS. 7 and 8 can be summarized in Table 8. In Table 8, reference characters VIB, HG, HC, PIA and COB are intended to means that vibraphone, Hawaiian guitar, harpsichord, piano and combination tones are selected, respectively. Reference character $COB+EN_1$ means that the switch $COB_1S$ for combination and the full ensemble switch $EN_1(EN_1S)$ are selected. Reference character VCF means that the VCF system tone is selected by the VCF system tone color selection switch 48 (48A). Reference character TVR means that the tone volume system tone is selected by the tone volume section 33 or 34. Numerals 1, 2, 3 . . . . in the column of priority order are intended to designate the first priority, the second priority, the third priority, and so forth. In the envelope control circuit 75 and the clock control circuit 67, an envelope switching mode relating to a tone or a system higher in priority is selected at all times. For instance, if the tone of the piano PIA is selected during the selection of the tone of the VCF system, the mode of VCF in Table 8 is cancelled, and the mode of PIA is selected.

Table 8

| System | Tone | Priority order | Switch section 81 & 82 | (Upper keyboard) FC | Mode X1 | Mode X2 | Decay clock |
|---|---|---|---|---|---|---|---|
| | VIB | 1 | | 1 | A | C | |
| Preset | | | DAMP | 2 | | | |
| | | | DAMP +FS | 1 | A | C | |
| | HG | 2 | Same as VIB | | | | PIC |
| | | | | 2 | | | |
| | | 3 | | 2 | | | |
| | | | | 1 | | | |
| | | | | 1 | | | |
| | | 4 Same as HC | | | | | |
| | | | | 3 | | | |
| | | | | 3 | | | |
| | | 5 | | 4 | | | |
| | | | | 6 | | | |
| | | | | 5 | | | |
| | | 6 Same as VCF when VCF on Same as COB when VCF off | | | | | |
| | | 7 | | 3 | | | |
| | | 8 Same as COB | | | | | |

In the column of Switch Section 81 & 82 of Table 8, the reference characters of the switches operated by the switch section 81 and 82 are indicated. More specifically, the reference characters DAMP, DAMP+FS, USUS, RESP, PEC, and PEC+USUS are intended to designate that the damp switch, the damp switch and the foot switch, the sustain control switch, the flute response switch, and the percussive decay switch and the sustain control switch are operated, respectively. In the harpsichord HC, the operation of the damp switch DAMP or the simultaneous operation of the damp switch DAMP and the foot switch FS (DAMP+FS) takes precedence over the operation of the sustain control switch USUS. In the combination system COB, the operation of sustain control switch USUS or the percussive decay switch PEC, or the simultaneous operation (PEC+USUS) of the percussive decay switch PEC and the sustain control switch USUS takes precedence over the operation of the flute response switch RESP. These priority conditions are apparent from FIG. 7.

Provided in the column of FC of Table 8 are the envelope function numbers indicated in Table 7. Accordingly, the contents of the envelope function data $FU_1$-$FU_3$ corresponding to the various switching conditions in Table 8 can be understood by referring to Table 7 and Table 8.

Indicated in the column of Mode in Table 8 are the modes of the envelope waveforms outputted through the output lines X1 and X2 of the envelope generator 15. Similarly as in Table 7 reference characters A, B, C and D are intended to designate the direct keying mode, the sustain mode, the percussion mode, and the percussive damp mode, respectively.

Indicated in the column of Decay clock in Table 8 are the voltages introduced to the line 93 for controlling the frequency of the upper keyboard decay clock signal CUD. Only the decay voltage VU can be varied by the operation of the variable resistor 96. Therefore, the decay time of the envelope waveform can be varied only when the voltage VU is supplied. The other voltages $V_{DD}$-SD are fixed to the predetermined values, as was described before.

In the envelope control circuit 75 in FIG. 7, the lower keyboard envelope function data $FL_1$, $FL_2$ is switched according to the conditions of the flute response switch RESP, the lower keyboard sustain control switch LSUS, and the automatic arpeggio performance selection switch CPF. These switches CPF, LSUS and RESP are priority-connected in the stated order. The relationships among the operating conditions of these switches, the values of the data $FL_1$ and $FL_2$ provided according to the operations of the switches, and the modes of the envelope waveforms generated by the envelope generator 15 outputted through the line X1 according to the value of the data, are as indicated in Table 9 below:

Table 9

| Selected Switch | | $FL_1$ | $FL_2$ | X1 |
|---|---|---|---|---|
| CPF | CPSL "1" | 0 | 1 | C |
| | CPSL "0" | 0 | 0 | A |
| | LSUS | 1 | 0 | B |
| | RESP | 0 | 0 | A |
| | — | 1 | 0 | B |

As the waveform memory group 19 is not used for the lower keyboard tone, the envelopes outputted through the line X2 are unnecessary for the lower keyboard tone. The reference characters A, B and C indicates the respective envelope mode similarly as in Table 7 and Table 8. When the automatic arpeggio performance selection switch CPF is turned on, the level of the automatic arpeggio performance selection signal CPS is raised to "1", and this signal CPS is applied to the automatic arpeggio performance control device 29 (FIG. 1) to enable the latter. In the device 29, the automatic arpeggio performance can be started and stopped by operating a foot switch (not shown). As a result of this control, the above-described automatic arpeggio selection signal CPSL is produced when the automatic arpeggio performance is actually effected. That signal CPSL is applied to the switch, on the data $FL_2$ side, of the automatic arpeggio selection switch CPF. With this switch CPF on, the signal CPSL is at the "1" level, and the data $FL_2$ has "1" when the automatic arpeggio performance is actually carried out. Accordingly, the data $FL_1$ $FL_2$ is "01", and the envelope waveform of the percussion mode C is outputted through the output line X1 of the envelope generator 15 at the channel time to which the lower keyboard tone is assigned. When the automatic arpeggio performance is temporarily suspended by the operation of the foot switch or the like, the signal CPSL is at the "0" level, and the function data $FL_1$, $FL_2$ is "00". As a result, the envelope waveform of the direct keying mode A is provided through the output line X1 of the envelope generator 15. Accordingly, tone production of the automatic arpeggiio performance is, in general, effected with the percussion envelope; however, it is changed to the sustain tone when the automatic arpeggio performance is temporarily suspended. When all of the switches RESP-CPF are in off state, the data $FL_1$, $FL_2$ is "10", and the lower keyboard tone is produced with the sustain mode envelope; however, upon operation of the flute response switching RESP, the data $FL_1$, $FL_2$ becomes "00", and it is changed to the direct keying mode envelope; and furthermore upon operation of the sustain control switch LSUS, the flute response is cancelled, and it is changed to the sustain mode envelope.

The lower keyboard decay clock signal CLD is controlled by the voltage control type oscillator 99 in FIG. 8. Ordinarily, as the short decay voltage SD is applied to the voltage controlled type oscillator 99 through the line 100, the decay time of the sustain mode envelope waveform is short. However, upon switing on the sustain control switch LSUS, the voltage VL whose value can be changed by means of the variable resistor 97 as desired is supplied to the line 100 so as to vary the frequency, or the decay time, of the decay clock signal CLD. In the case where the automatic arpeggio performance is selected, the switch CPF is turned on, and the predetermined voltage VCP for setting the decay time of the percussion envelope is supplied to the line 100.

The pedal keyboard decay clock signal CPD can be varied by a voltage controlled type oscillator 101, and the voltage VF obtained through the variable resistor 98 for controlling the decay time of the pedal keyboard tone is applied to the control input of the oscillator 101. In the example shown in FIG. 8, the attack clock signals CPA and CA are generated by fixed frequency type oscillator 102 and 103; however, these oscillators may be so designed that the frequencies are variable.

In the above-described embodiment, the musical tone forming systems of the upper keyboard tone are divided into three parts; the preset system, the VCF system, and the tone volume system, and the priority order is established in the order stated; however, the method of establishing the priority order is not limited thereto or thereby, and the method of dividing the systems is not limited thereto or thereby. For instance, it is possible that the system of the combination mixer 45 and the combination system preset tone selector 46 is handled as a system different from the preset system, and the priority order is established among four systems; the preset system extending from the waveform memory group 19 to the preset tone selector 43, the combination system, the VCF system, and the tone volume system.

As is apparent from the above description, according to this invention, the systems used for musical tone production are automatically switched according to the priority order established for a plurality of musical tone forming systems, and if necessary, musical tones can be produced simultaneously in all of the systems merely by operating the ensemble switch. Accordingly, the time required for the on-off operations of a number of tone selecting switches provided for the various musical tone forming systems can be eliminated. This means that the performance of an intricate electronic musical instrument with a number of operating levers can be readily effected and the performance efficiency of such an electronic musical instrument is remarkably improved.

What is claim is:

1. An electronic musical instrument having keys and a plurality of musical tone forming systems capable of concurrently producing tones of different tonal quality for notes designated by selection of the same subset of keys, the outputs of all of said tone forming systems being connected to a common output unit, said instrument also having selection means for facilitating selection by a performer of which tone forming systems shall be employed for one production, which instrument comprises:

priority means, cooperating with said selection means, for establishing a priority order among said musical tone forming systems to employ for musical tone production that one tone forming system having a highest priority out of one or plural systems selected by a performer from said plurality of musical tone forming systems; and ensemble selection means, cooperating with said selection means and with said priority means and operative upon selection of ensemble production by said performer, for enabling predetermined plural systems among said musical tone forming systems to be employed concurrently for musical tone production instead of musical tone production by one system according to said priority order.

2. An electronic musical instrument according to claim 1 wherein individual ones of said tone forming systems are capable of producing plural different tonal qualities, said tonal qualities being individually selectable by said performer using said selection means, said priority means also establishing priority of tone production among said plural different tonal qualities producible by said individual tone forming system.

3. An electronic musical instrument according to claim 2 further comprising:

envelope generator means for establishing the envelope waveshape of the tones produced by each tone forming system, and envelope shape control means, cooperating with said selection means, for controlling the envelope waveshape established by said generator means so as to be compatible with the selected tonal quality produced by the associated tone forming system.

4. An electronic musical instrument according to claim 3 further comprising:

envelope waveshape modification control means, operable by the performer and cooperating with said envelope generator means, for modifying in response to performer control the envelope waveshape established by said envelope generator means for a selected tonal quality.

5. An electronic musical instrument according to claim 3 wherein portions of the envelope waveshape may be modified in response to different clock pulse rates supplied to said envelope generator means, together with: p1 clock pulse source means for providing clock pulses to said envelope generator means, and p1 clock pulse rate control means, cooperating with said selection means and said priority means, for causing said clock pulse source means to provide clock pulses to said envelope generator means at rates selected in accordance with the selected tonal quality.

6. An electronic musical instrument comprising:

a plurality of different tone forming systems each capable of producing a musical tone of tonal quality different from the tones for the same note produced by others of the tone forming systems, note selection means for selecting notes to be played, said plural tone forming systems all being connected to said note selection means so as to concurrently produce, if enabled, tones of different tonal quality for the same selected note, envelope generator means, connected to said plural tone forming systems, for establishing the envelope waveshape of the tone produced by each of said tone forming systems, and tone selection means, cooperating with said tone forming systems and with said envelope generator means, for selecting which, if any, tonal quality is to be produced by each of said tone forming systems and for simultaneously controlling the envelope waveshape established by said envelope generator means for each of said tone forming systems to be compatible with the selected tonal quality to be produced thereby.

7. An electronic musical instrument according to claim 6 further comprising:

priority means, cooperating with said tone selection means, for enabling only a certain one of said tone forming systems in accordance with a preselected priority order in the event that tonal qualities from more than one tone forming system are selected.

8. An electronic musical instrument according to claim 7 wherein said tone selection means also includes ensemble selection circuitry for selection of concurrent tone production by more than one tone forming system, and wherein said priority means cooperates with said ensemble selection means to enable a certain preselected subset of said tone forming systems, in accordance with an established ensemble priority order, in respone to such selection of concurrent tone production.

9. An electronic musical instrument according to claim 6 and including a common output unit for receiving the tones produced by all of said tone forming systems, and wherein at least some of said tone forming systems are connected to said common output unit via respective gates, and wherein said tone selection means includes circuitry, actuated upon selection of a tonal quality produced by a certain one of said tone forming systems, for opening the gate of at least one other tone forming system thereby to prevent the tones produced by that other tone forming system from being received by said common output unit.

10. An electronic musical instrument according to claim 9 wherein said circuitry in said selection means includes switches associated with the production of different tonal qualities by said certain one of said tone forming systems, said switches being connected to said certain tone forming system, to said envelope generator means and to said gates, so that each switch, when actuated will enable production of an associated tonal quality by said certain tone forming system, will control said envelope generator means to establish an envelope waveshape compatible with said associated tonal quality, and will open the gate of at least one other tone forming system.

11. An electronic musical instrument according to claim 10 wherein each of said switches also controls the rate of a clock associated with said envelope generator means so as to establish an envelope waveshape production rate compatible with the selected tonal quality.

12. An electronic musical instrument according to claim 6 wherein indiviudal ones of said tone forming systems are capable of producing different tonal qualities, said tone selection means including circuitry for selecting amongst said different tonal qualities for an individual tone forming system in accordance with a preselected priority order, so that if more than one different tonal qualities are selected, said individual tone forming system will produce tones having only the tonal quality assigned to the highest priority in said order.

* * * * *